US007245851B2

(12) United States Patent
Fujii et al.

(10) Patent No.: US 7,245,851 B2
(45) Date of Patent: Jul. 17, 2007

(54) ELECTROPHOTOGRAPHIC APPARATUS

(75) Inventors: Atsushi Fujii, Kanagawa (JP); Masato Tanaka, Shizuoka (JP); Ryuji Higashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 487 days.

(21) Appl. No.: 10/978,581

(22) Filed: Nov. 2, 2004

(65) Prior Publication Data

US 2005/0111880 A1 May 26, 2005

(30) Foreign Application Priority Data

Nov. 26, 2003 (JP) ..... 2003-395871

(51) Int. Cl.
*G03G 15/047* (2006.01)
*G03G 15/26* (2006.01)

(52) U.S. Cl. ..... 399/118; 399/116; 399/159; 399/186; 430/56; 430/78

(58) Field of Classification Search ..... 399/116, 399/118, 159, 186; 430/56, 78
See application file for complete search history.

(56) References Cited

U.S. PATENT DOCUMENTS 5,666,589 A 9/1997 Yoshinaga et al. ..... 399/48
5,818,489 A 10/1998 Yoshinaga et al. ..... 347/131
6,183,922 B1 2/2001 Takai et al. ..... 430/72
6,548,216 B2 * 4/2003 Kawamura et al. ..... 430/59.6

FOREIGN PATENT DOCUMENTS

JP 09-240051 9/1997
JP 10-239956 9/1998

* cited by examiner

*Primary Examiner*—Hoa Van Le
(74) *Attorney, Agent, or Firm*—Fitzpatrick, Cella, Harper & Scinto

(57) ABSTRACT

In an electrophotographic apparatus having a blue (purple) semiconductor laser as a light source, the electrophotographic apparatus has an electrophotographic photosensitive member, a charging means, an exposure means, a developing means, a transfer means and a destaticizing means. The exposure means has a semiconductor laser and the destaticizing means having a light-emitting diode, wherein wavelength λa (nm) of the semiconductor laser, wavelength λb (nm) of the light-emitting diode and wavelength λc (nm) at which the electrophotographic photosensitive member has a maximum spectral sensitivity satisfy the following relationship (1):

$$\lambda a<\lambda c<\lambda b \quad (1)$$

and any of the λa, the λb and the λc is within the range of from 380 nm to 520 nm.

12 Claims, 4 Drawing Sheets

ELECTROPHOTOGRAPHIC APPARATUS

BACKGROUND OF THE INVENTION

1. Field of the Invention

This invention relates to an image forming apparatus (electrophotographic apparatus) such as a copying machine, a printer, a facsimile machine or a platemaking system, which employs an electrophotographic process.

2. Related Background Art

In recent years, various approaches are taken because of an increasing need for the achievement of ultrahigh image quality in regard to images reproduced from the image forming apparatus. In particular, the exposure process that forms an electrostatic latent image on the surface of an electrophotographic photosensitive member is positioned on the upstream side in the electrophotographic process, and is the basis of image formation. Accordingly, making beam spot diameter small in the exposure process enables achievement of ultrahigh resolution, and is a very effective means for the achievement of ultrahigh image quality.

Near infrared region semiconductor lasers having conventionally been used have lasing wavelengths of about 650 to 780 nm, and have spot diameter of about 100 μm. Its limit has been about 50 to 80 μm whatever improvements are made on various optical members in order to make the beam spot diameter small. Also, even if improvements on various optical members have made the beam spot diameter small, it is difficult to obtain the sharpness of a contour of the beam spot. This is known from the diffraction limit of laser beams that is represented by the following equation (9). The following equation (9) shows that the lower limit of beam spot diameter (D) of a beam spot is proportional to the wavelength (λ) of the laser beam. ($N_A$ is the numerical aperture of a lens.)

$$D=1.22\lambda/N_A \tag{9}$$

Accordingly, it is contemplated to use as an exposure light source (a writing light source) of the electrophotographic apparatus a short-wavelength blue (purple) semiconductor laser (hereinafter simply "blue semiconductor laser"), which is being put into practical use in DVD and so forth in recent years (see, e.g., Japanese Patent Application Laid-open No. H9-240051, page 2, claim 1). Compared with the conventional near infrared region semiconductor lasers, in the case when the blue (purple) semiconductor laser having about a half lasing wavelength (380 to 450 nm) is used as an exposure light source, the beam spot can be made to have a fairly small spot diameter in the state the sharpness of the contour of the beam spot is maintained, as shown in the above equation (9). Hence, this enables achievement of ultrahigh resolution, and is very advantageous for the achievement of ultrahigh image quality.

Thus, the use of the blue (purple) semiconductor laser as an exposure light source makes it possible for the surface of an electrophotographic photosensitive member to be irradiated with a laser beam in a spot diameter of about 40 μm or less in the state the sharpness of its contour is maintained.

In an electrophotographic apparatus having such a blue (purple) semiconductor laser as an exposure light source and made to have a small beam spot diameter, an electrophotographic photosensitive member having a certain or higher sensitivity to light irradiation of an image exposure device is required as a matter of course. Further, in order for the electrophotographic photosensitive member to effectively utilize the light with which it is irradiated, the photosensitive member is required to have a maximum spectral sensitivity at wavelengths of about 380 to 520 nm. However, very few electrophotographic photosensitive members have such a maximum spectral sensitivity at the wavelengths of about 380 to 520 nm. For example, Japanese Patent Application Laid-open No. H10-239956, page 5, discloses a report concerning a selenium (Se-Te) photosensitive member which is an inorganic photosensitive member having a maximum spectral sensitivity at a wavelength of about 460 nm.

Meanwhile, in these days, various studies are made which take note of application of the blue semiconductor laser to organic photosensitive members which have various advantages that they have a small environmental load, can be manufactured and handled with ease and enjoy a low cost. For example, Japanese Patent Application Laid-open No. H10-239956, page 3 and FIG. 4 on page 6, discloses an image forming apparatus in which a photosensitive member having a maximum spectral sensitivity at wavelengths of 600 nm or less is used in combination with a laser diode which emits a short-wavelength laser beam. It shows an embodiment which makes use of an organic photosensitive member making use of a perylene type or azo type pigment as a charge-generating material and having a maximum spectral sensitivity at wavelengths of 540 to 580 nm. In this case, in respect of spectral sensitivity, a light source having a wavelength of about 640 nm or more (a red LED or the like) is considered usable which is conventionally used in destaticizers (charge elimination devices). However, organic photosensitive members can not be said to be effectively used in respect to the lasing wavelengths of 380 to 450 nm the blue (purple) semiconductor laser has. In an attempt to make the amount of laser light extremely large to secure sensitivity in order to more improve their sensitivity, the running potential may vary so greatly as to be insufficient for the reproduction of stable images with ultrahigh image quality throughout their running. At the same time, they also involve various disadvantages that the reliability of lasers to reproduction stability may lower, a high laser cost may result and the laser may have a short lifetime. Moreover, there is a limit to laser power, and proper sensitivity can not always be secured.

On account of the foregoing, it is sought to use an organic photosensitive member having a maximum spectral sensitivity at the wavelengths of 380 to 520 nm. However, as stated above, it is very difficult in regard to materials to design an organic photosensitive member which can effectively used in respect to the lasing wavelengths of 380 to 450 nm the blue (purple) semiconductor laser has. In addition, it has newly been found that, where such an organic photosensitive member having a maximum spectral sensitivity at the wavelengths of 380 to 520 nm is used and is used at a proper amount of light of the blue (purple) semiconductor laser, although it can be said to be effectively used in respect to the laser irradiation light, there is a technical problem that the running potential varies greatly. Hence, even the organic photosensitive member having a maximum spectral sensitivity in the wavelength region of the blue (purple) semiconductor laser has been insufficient for the reproduction of stable images with ultrahigh image quality throughout its running.

SUMMARY OF THE INVENTION

An object of the present invention is to solve the above problems, in an electrophotographic apparatus having the blue (purple) semiconductor laser as a light source and making use of the electrophotographic photosensitive member having a maximum spectral sensitivity at the wavelengths of 380 to 520 nm. More specifically, an object of the present invention is to provide an electrophotographic apparatus having the blue (purple) semiconductor laser as a light source, and enabling reproduction of stable images with ultrahigh image quality throughout its running in the state the irradiation light is effectively utilized in its use in a suitable amount of laser light.

The present inventors have made extensive studies in order to achieve the above object. As the result, they have found that the problem of causing great variations of running potential in the electrophotographic apparatus having the blue (purple) semiconductor laser as a light source and making use of the electrophotographic photosensitive member having a maximum spectral sensitivity at the wavelengths of 380 to 520 nm is caused by the destaticizer. They considered that, in the light source having a wavelength of about 640 nm or more (a red LED or the like) that is conventionally in wide use in the destaticizer, no sufficient charge elimination is performed and electric charges are continued to be accumulated in the photosensitive layer during running, so that the running potential varies greatly. They considered that the wavelength of such a light source of the destaticizer has the deepest concern with the above problem to affect the reproduction of images with ultrahigh image quality throughout running. Accordingly, they have found that a destaticizer having a light source of shorter wavelength than conventional ones may be used which corresponds to the wavelength of 380 to 520 nm at which the organic photosensitive member has a maximum spectral sensitivity. They have further found that, among such wavelengths, a short-wavelength LED (light-emitting diode) of 520 nm or less is effective.

They have still further found that, though any detailed mechanism is unclear, very stable images with ultrahigh resolution and ultrahigh image quality can be reproduced throughout running only when the three wavelengths, i.e., the wavelength of the semiconductor laser, the wavelength of the LED in the destaticizer and the wavelength at which the organic photosensitive member has a maximum spectral sensitivity, are in a specific relationship. At the same time, they have still further found that, though any detailed mechanism is also unclear, very stable images with ultrahigh resolution and ultrahigh image quality can be reproduced throughout running only when both the sensitivity of photosensitive member at the wavelength of the semiconductor laser in the image exposure device and the sensitivity of photosensitive member at the wavelength of the LED in the destaticizer are in a specific relationship.

More specifically, according to the present invention, first provided is an electrophotographic apparatus having an electrophotographic photosensitive member, a charging means, a semiconductor laser as an exposure means, a developing means, a transfer means and a light-emitting diode as a destaticizing means for the electrophotographic photosensitive member, wherein;

wavelength λa (nm) of the semiconductor laser, wavelength λb (nm) of the light-emitting diode and wavelength λc (nm) at which the electrophotographic photosensitive member has a maximum spectral sensitivity satisfy the following relationship (1):

$$\lambda a<\lambda c<\lambda b \quad (1)$$

and any of the λa, the λb and the λc is within the range of from 380 nm to 520 nm.

Second provided is the electrophotographic apparatus described above, wherein photosensitive-member sensitivity Sa ($V\cdot m^2/cJ$) at the λa (nm) and photosensitive-member sensitivity Sb ($V\cdot m^2/cJ$) at the λb (nm) satisfy the following relationship (2):

$$Sb/Sa \geqq 0.8 \quad (2).$$

Third provided is the electrophotographic apparatus described above, wherein photosensitive-member sensitivity Sa ($V\cdot m^2/cJ$) at the λa (nm) and photosensitive-member sensitivity Sb ($V\cdot m^2/cJ$) at the λb (nm) satisfy the following relationship (3):

$$Sb/Sa \geqq 1.0 \quad (3).$$

Fourth provided is the electrophotographic apparatus described above, wherein the electrophotographic photosensitive member is an organic photosensitive member.

Fifth provided is the electrophotographic apparatus described above, wherein the organic photosensitive member has a photosensitive layer containing as a charge-generating material an azo compound having the following structural formula (4):

$$Cp1—N{=}N—Ar—N{=}N—Cp2 \quad (4)$$

wherein Ar represents a substituted or unsubstituted aromatic hydrocarbon ring, a substituted or unsubstituted heterocyclic ring or a ring formed by combination of these directly or via a linking group, and Cp1 and Cp2 independently represent coupler residual groups having phenolic hydroxyl groups of the same type or different types; except, however, that the two —N═N—Cp moieties are bonded to the same benzene ring.

Six provided is the electrophotographic apparatus described above, wherein the organic photosensitive member has a photosensitive layer containing as a charge-generating material a porphyrin compound having the following structural formula (5):

(5)

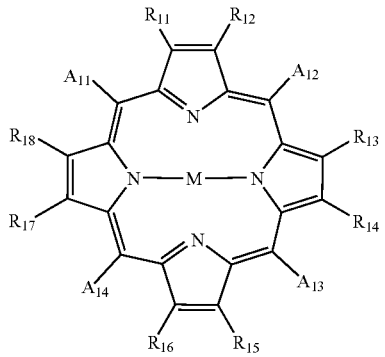

wherein M represents a hydrogen atom or a metal which may have an axial ligand; $R_{11}$ to $R_{18}$ each independently represent a hydrogen atom, an alkyl group which may have a substituent, an aromatic ring which may have a substituent, an amino group which may have a substituent, a sulfur atom which may have a substituent, an alkoxyl group, a halogen atom, a nitro group or a cyano group; $A_{11}$ to $A_{14}$ each independently represent a hydrogen atom, an alkyl group which may have a substituent, an aromatic ring which may have a substituent, or a heterocyclic ring which may have a substituent, provided that at least one of them represents a heterocyclic ring which may have a substituent.

Seventh provided is the electrophotographic apparatus described above, wherein the azo compound of the structural formula (4) is represented by the following structural formula (6):

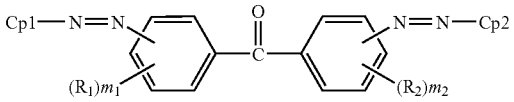

(6)

wherein $R_1$ and $R_2$ may be the same or different and each independently represent an alkyl group which may have a substituent, an aryl group which may have a substituent, or a halogen atom; $m_1$ and $m_2$ each represent an integer of 0 to 4; and Cp1 and Cp2 independently represent coupler residual groups having phenolic hydroxyl groups of the same type or different types.

Eighth provided is the electrophotographic apparatus described above, wherein at least one of the Cp's in the structural formula (4) is represented by the following structural formula (7) or (8):

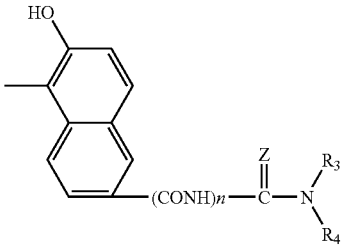

(7)

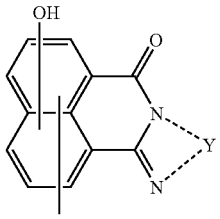

(8)

wherein $R_3$ and $R_4$ each represent a hydrogen atom, an alkyl group which may have a substituent, an aryl group which may have a substituent, or a heterocyclic ring group which may have a substituent, and $R_3$ and $R_4$ may form a cyclic amino group via the nitrogen atom in the formula; Z represents an oxygen atom or a sulfur atom; n represents an integer of 0 or 1; and Y represents a divalent aromatic hydrocarbon ring group which may have a substituent, or a divalent nitrogen-containing heterocyclic ring group which may have a substituent.

Ninth provided is the electrophotographic apparatus described above, wherein the structural formula (4) is the following structural formula (6), and at least one of the Cp1 and Cp2 is represented by the following structural formula (7) or (8):

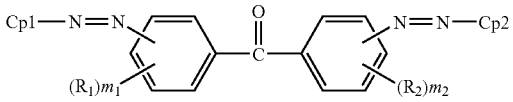

(6)

wherein $R_1$ and $R_2$ may be the same or different and each independently represent an alkyl group which may have a substituent, an aryl group which may have a substituent, or a halogen atom; and $m_1$ and $m_2$ each represent an integer of 0 to 4;

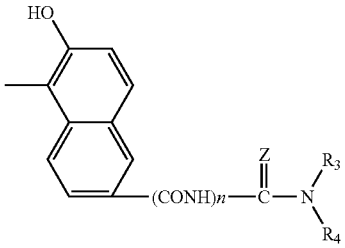

(7)

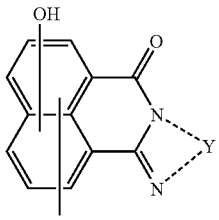

(8)

wherein $R_3$ and $R_4$ each represent a hydrogen atom, an alkyl group which may have a substituent, an aryl group which may have a substituent, or a heterocyclic ring group which may have a substituent, and $R_3$ and $R_4$ may form a cyclic amino group via the nitrogen atom in the formula; Z represents an oxygen atom or a sulfur atom; n represents an integer of 0 or 1; and Y represents a divalent aromatic hydrocarbon ring group which may have a substituent, or a divalent nitrogen-containing heterocyclic ring group which may have a substituent.

Tenth provided is the electrophotographic apparatus described above, wherein the compound represented by the structural formula (5) is a 5,10,15,20-tetrapyridyl-21H,23H-porphyrin compound, in which $R_{11}$ to $R_{18}$ are all hydrogen atoms and $A_{11}$ to $A_{14}$ are all pyridyl groups.

Eleventh provided is the electrophotographic apparatus described above, wherein the 5,10,15,20-tetrapyridyl-21H, 23H-porphyrin compound is a 5,10,15,20-tetrapyridyl-21H, 23H-porphyrin crystal of a crystal form having peaks at 8.2°, 19.7°, 20.8° and 25.9° of Bragg's angle (2θ±0.2°) in the CuKα characteristic X-ray diffraction.

Twelfth provided is the electrophotographic apparatus described above, wherein the destaticizing means is provided in such a way that it performs any one, or two or more, of charging pre-exposure, transfer pre-exposure, transfer simultaneous exposure and cleaning pre-exposure.

DETAILED DESCRIPTION OF THE PREFERRED EMBODIMENTS

The present invention is described below in detail.

The electrophotographic apparatus of the present invention consists basically of an electrophotographic photosensitive member, a charging means, an exposure means (or an image exposure device), a developing means, a transfer means and a destaticizing means (or a destaticizer). The exposure means has a semiconductor laser and the destaticizing means has a light-emitting diode (LED).

The semiconductor laser of the image exposure device in the electrophotographic apparatus of the present invention is described first. As the semiconductor laser, its beam spot is required to have a small spot diameter in order to achieve ultrahigh image quality, and its lasing wavelength may preferably be from 380 nm to 520 nm, and more preferably from 380 nm to 450 nm. As types of the laser, a ZnSe semiconductor laser and a GaN semiconductor laser are preferred. Further taking account of its durability required when set in the electrophotographic apparatus, the GaN semiconductor laser is particularly preferred. With regard to laser exposure output, it may preferably be 1 mW or more, more preferably 3 mW or more, and particularly preferably 5 mW or more.

The destaticizer in the electrophotographic apparatus of the present invention is described next. As a destaticizing light source having conventionally been used, it includes a fluorescent lamp, a tungsten lamp, a halogen lamp, a mercury lamp, a sodium lamp and the LED. In the present invention, in view of stability against running potential variations due to an improvement in destaticizing performance, short-wavelength LEDs of 520 nm or less, i.e., a blue LED (464 to 475 nm) and a bluish green LED (495 to 505 nm) are most preferred, for example.

The electrophotographic photosensitive member used in the electrophotographic apparatus of the present invention is described next. As the electrophotographic photosensitive member, it is preferable to use an organic photosensitive member because of its advantages that it is harmless, is easy to manufacture and handle, is low-cost and has selectivity in material designing in respect to spectral sensitivity.

Figure 1:
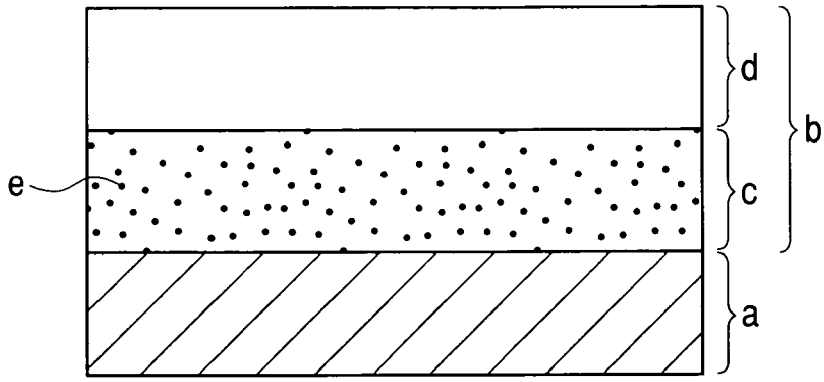
FIG. 1 is a sectional view showing an example of layer configuration of an organic photosensitive member.
Figure 2:
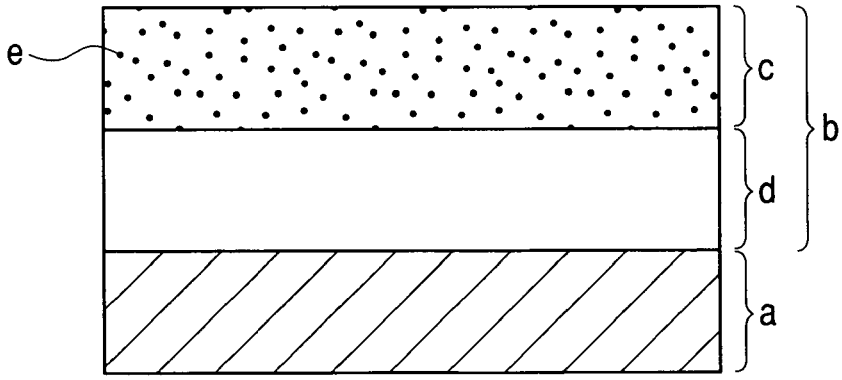
FIG. 2 is a sectional view showing another example of layer configuration of an organic photosensitive member.
Figure 3:
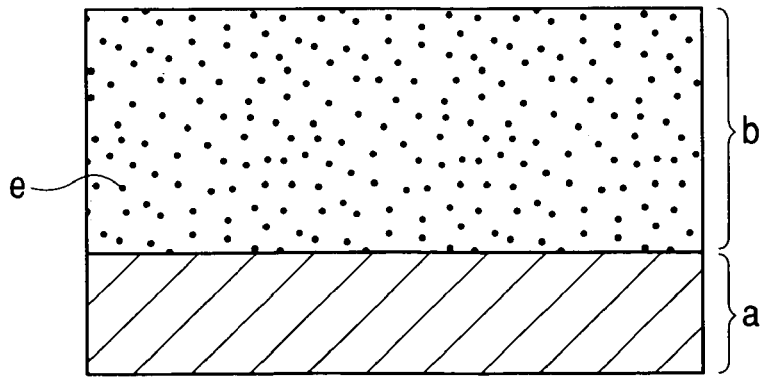
FIG. 3 is a sectional view showing a still another example of layer configuration of an organic photosensitive member.

As to layer configuration of the organic photosensitive member, it may be any known layer configuration as shown in FIGS. 1 to 3. Of these, it may preferably be the layer configuration shown in FIG. 1. In FIGS. 1 to 3, letter symbol a denotes a support; b, a photosensitive layer; c, a charge generation layer; d, a charge transport layer; and e, a charge-generating material.

In regard to a function-separated organic photosensitive member comprising a support and superposed thereon a charge generation layer and a charge transport layer in this order, a manner for its manufacture is described below.

As materials for the support, they may be those having conductivity. For example, usable are aluminum, aluminum alloys, copper, zinc, stainless steel, vanadium, molybdenum, chromium, titanium, nickel, indium, gold and platinum. Also usable are a plastic support (such as a polyethylene, polypropylene, polyvinyl chloride, polyethylene terephthalate or acrylic resin support) film-formed thereon by vacuum deposition of any of the above metals or an alloy thereof; a support formed of the above plastic, metal or alloy and coated thereon with conductive fine particles (such as carbon black or silver particles) together with a suitable binder resin; and a support formed of plastic or paper impregnated therein with conductive particles.

On the support, a conductive layer may be provided which is intended for the covering of unevenness or defects of the support or for the prevention of interference fringes.

The conductive layer may be formed by coating the support with a dispersion prepared by dispersing conductive particles such as carbon black, metal particles or metal oxide particles in a binder resin. The conductive layer may preferably be in a layer thickness of from 1 μm to 40 μm, and particularly preferably from 1 μm to 30 μm.

The surface of the support made of aluminum or an aluminum alloy may also be subjected to roughing by honing, centerless grinding, cutting or the like. By such roughing, the surface of the support can further be designed to have an appropriate roughness, making it possible to execute a countermeasure against interference fringes. The support may preferably have a ten-point average roughness Rz jis of 0.05 μm or more, and particularly preferably 0.1 μm or more.

The ten-point average roughness Rz jis is measured according to JIS B 0610 (2001) by means of SURFCORDER SE-3500 (manufactured by Kosaka Laboratory Ltd.), setting the cut-off to 0.8 mm and measurement length to 8 mm.

An intermediate layer having the function as a barrier and the function of adhesion may also be provided on the support or conductive layer. As materials for the intermediate layer, usable are polyvinyl alcohol, polyethylene oxide, ethyl cellulose, methyl cellulose, casein, polyamide, glue and gelatin. Any of these materials may be dissolved in a suitable solvent, followed by coating on the support or conductive layer. The intermediate layer may preferably be in a layer thickness of from 0.2 μm to 3.0 μm.

On the support, conductive layer or intermediate layer, the charge generation layer is formed.

The charge generation layer may be formed by coating on the support, conductive layer or intermediate layer a fluid prepared by dispersing a charge-generating material in a suitable solvent together with a binder resin; followed by drying. The charge-generating material may be any material as long as it has a maximum spectral sensitivity in the range of from 380 nm to 520 nm. In respect of spectral sensitivity, it may preferably be an azo compound or a porphyrin compound. Further, it may particularly preferably be an azo compound having a specific structure, or a porphyrin compound having a specific structure and a specific crystal form.

Structure of the azo compound is described next. The azo compound may preferably be one represented by the structural formula (4) shown previously. In the structural formula (4), the group represented by Ar may include aromatic hydrocarbon rings such as benzene, naphthalene, fluorene, phenanthrene, anthracene and pyrene; heterocyclic rings such as furan, thiophene, pyridine, indole, benzothiazole, carbazole, acridone, dibenzothiophene, benzoxazole, oxadiazole and thiazole; and rings formed by combining any of the above aromatic hydrocarbon rings and heterocyclic rings directly or with an aromatic group or a non-aromatic group, as exemplified by biphenyl, binaphthyl, diphenylamine, triphenylamine, N-methyldiphenylamine, fluorenone, phenanthrenequinone, benzoquinone, naphthoquinone, anthraquinone, benzanthrone, terphenyl, diphenyloxadiazole, stilbene, distyrylbenzene, azobenzene, azoxybenzene, phenylbenzoxazole, diphenylmethane, bibenzyl, diphenylsulfone, diphenyl ether, diphenyl sulfide, benzophenone, benzanilide, tetraphenyl-p-phenylenediamine, tetraphenylbenzidine, N-phenyl-2-pyridylamine and N-diphenyl-2-pyridylamine. The substituent these groups may have may include alkyl groups such as methyl, ethyl, propyl and butyl; alkoxyl groups such as methoxyl, ethoxyl and propoxyl; halogen atoms such as a fluorine atom, a chlorine atom and a bromine atom; dialkylamino groups such as dimethylamino and diethylamino; and a hydroxyl group, a nitro group, a cyano group, and halomethyl groups.

The azo compound represented by the structural formula (4) may further preferably be a bonzophenone which may have a substituent, represented by the structural formula (6) shown previously. In the structural formula (6), $R_1$ and $R_2$ may be the same or different and each independently represent an alkyl group which may have a substituent, an aryl group which may have a substituent, or a halogen atom. The substituent may include alkyl groups, aryl groups and halogen atoms. $m_1$ and $m_2$ each represent an integer of 0 to 4.

The Cp1 and Cp2 in the structural formulas (4) and (6) may include coupler residual groups having phenolic hydroxyl groups of the same type or different types. For example, usable are aromatic hydrocarbon compounds having hydroxyl groups, such as phenols and naphthols both having hydroxyl groups, and heterocyclic compounds having hydroxyl groups. More preferably, the coupler residual groups may be those represented by the structural formula (7) and/or structural formula (8) shown previously.

The alkyl group each represented by $R_3$ and $R_4$ in the structural formula (7) may include groups such as methyl, ethyl and propyl; the aryl group, groups such as phenyl, naphthyl and anthryl; the heterocyclic group, groups such as pyridyl, thienyl, carbazolyl, benzimidazolyl and benzothiazolyl; and the cyclic amino group having a nitrogen atom in the ring, pyrrole, pyrroline, pyrrolidine, pyrrolidone, indole, indoline, carbazole, imidazole, pyrazole, pyrazoline, oxazine and phenoxazine.

The substituent these groups may have may include alkyl groups such as methyl, ethyl, propyl and butyl; alkoxyl groups such as methoxyl, ethoxyl and propoxyl; halogen atoms such as a fluorine atom, a chlorine atom and a bromine atom; dialkylamino groups such as dimethylamino and diethylamino; and a hydroxyl group, a nitro group, a cyano group, halomethyl groups, and halomethoxyl groups.

Of these, a case in which any one of $R_3$ and $R_4$ is a hydrogen atom and the other is a phenyl group which may have a substituent is preferred in view of spectral sensitivity. Further, the substituent of the phenyl group may preferably be an alkyl group, a nitro group, a cyano group, a trifluoromethyl group, a trifluoromethoxyl group, an acetyl group, a halogen atom or a phenylcarbamoyl group. The phenyl group of this phenylcarbamoyl group may further have the substituent described above.

The divalent aromatic hydrocarbon ring group and divalent nitrogen-containing heterocyclic ring group represented by Y in the structural formula (8) may include divalent groups such as o-phenylene, o-naphthylene, perinaphthylene, 1,2-anthryl, 3,4-pyrazoldiyl, 3,4-pyridiyl, 4,5-pyridiyl, 6,7-imidazoldiyl and 6,7-quinolindiyl.

The substituent the group Y may have may include alkyl groups such as methyl, ethyl, propyl and butyl; alkoxyl groups such as methoxyl, ethoxyl and propoxyl; halogen atoms such as a fluorine atom, a chlorine atom and a bromine atom; dialkylamino groups such as dimethylamino and diethylamino; and a hydroxyl group, a nitro group, a cyano group, and halomethyl groups.

Most preferably, the azo compound may further include an azo compound formed by combination of a central skeleton in which the structural formula (4) is the structural formula (6) and at least one of the Cp1 and Cp2 in the structural formula (4) is represented by the structural formula (7) or (8), with a coupler.

All of these azo compounds may also have a crystal form which is either crystalline or amorphous.

Structure and crystal form of the porphyrin compound are described next. The porphyrin compound may preferably be one represented by the structural formula (5) shown previously. In the structural formula (5), M represents a hydrogen atom or a metal which may have an axial ligand. Incidentally, where M is a hydrogen atom, the structure represented by the above formula (5) makes a structure represented by the following formula (5)'.

(5)'

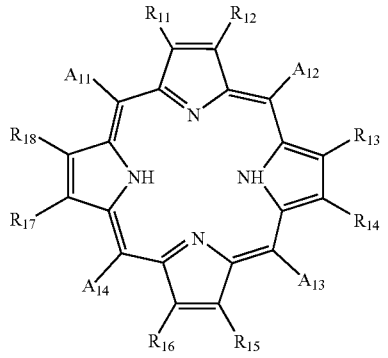

The metal which may have an axial ligand may include metals such as Mg, Zn, Ni, Cu, V, Ti, Ga, Sn, In, Al, Mn, Fe, Co, Pb, Ge and Mo. The axial ligand may include halogen atoms, an oxygen atom, a hydroxyl group, alkoxyl groups, an amino group and alkylamino groups.

$R_{11}$ to $R_{18}$ each independently represent a hydrogen atom, an alkyl group which may have a substituent, an aromatic ring which may have a substituent, an amino group which may have a substituent, a sulfur atom which may have a substituent, an alkoxyl group, a halogen atom, a nitro group or a cyano group.

$A_{11}$ to $A_{14}$ each independently represent a hydrogen atom, an alkyl group which may have a substituent, an aromatic ring which may have a substituent, or a heterocyclic ring which may have a substituent.

The alkyl group may include a methyl group, an ethyl group, a propyl group and a butyl group. The aromatic ring may include a benzene ring, a naphthalene ring and an anthracene ring. The alkoxyl group may include a methoxyl group and an ethoxyl group. The halogen atom may include a fluorine atom, a chlorine atom, a bromine atom and an iodine atom. The heterocyclic ring may include a pyridine ring, a thiophene ring, an imidazole ring, a pyrazine ring, a triazine ring, an indole ring, a coumarin ring, a fluorenone ring, a benzofuran ring and a pyran ring.

The substituent the above ones may have may include alkyl groups such as a methyl group, an ethyl group, a propyl group and a butyl group; alkoxyl groups such as a methoxyl group and an ethoxyl group; alkylamino groups such as a methylamino group, a dimethylamino group and a diethylamino group; arylamino groups such as a phenylamino group and a diphenylamino group; halogen atoms such as a fluorine atom, a chlorine atom and a bromine atom; a hydroxyl group; a nitro group; a cyano group; and halomethyl groups such as a trifluoromethyl group.

Among porphyrin compounds having the structure represented by the formula (5), preferred is a 5,10,15,20-tetrapyridyl-21H,23H-porphyrin compound, in which $A_{11}$ to $A_{14}$ are all pyridyl groups.

Of the foregoing, preferred is a 5,10,15,20-tetra(4-pyridyl)-21H,23H-porphyrin compound, in which all the pyridyl groups are 4-pyridyl groups.

Of the 5,10,15,20-tetrapyridyl-21H,23H-porphyrin compound, preferred are 5,10,15,20-tetrapyridyl-21H,23H-porphyrin compounds of a crystal form having a peak at 20.0±1.0° of Bragg's angle 2θ in the CuKα characteristic X-ray diffraction, such as 5,10,15,20-tetra(4-pyridyl)-21H,23H-porphyrin crystals of a crystal form having peaks at 8.2°, 19.7°, 20.8° and 25.9° of Bragg's angle (2θ±0.2°) in the CuKα characteristic X-ray diffraction, 5,10,15,20-tetra(3-pyridyl)-21H,23H-porphyrin crystals of a crystal form having peaks at 7.1°, 8.4°, 15.6°, 19.5°, 21.7°, 22.4° and 23.8° of Bragg's angle (2θ±0.2°) in the CuKα characteristic X-ray diffraction, and 5,10,15,20-tetra(2-pyridyl)-21H,23H-porphyrin crystals of a crystal form having a peak at 20.4° of Bragg's angle (2θ±0.2°) in the CuKα characteristic X-ray diffraction.

Of the foregoing, preferred are 5,10,15,20-tetra(4-pyridyl)-21H,23H-porphyrin crystals of a crystal form having peaks at 8.2°, 19.7°, 20.8° and 25.9° of Bragg's angle (2θ±0.2°) in the CuKα characteristic X-ray diffraction (Crystals E).

Of the 5,10,15,20-tetra(4-pyridyl)-21H,23H-porphyrin compound, also preferred are 5,10,15,20-tetra(4-pyridyl)-21H,23H-porphyrinatozinc crystals.

Of the foregoing, preferred are 5,10,15,20-tetra(4-pyridyl)-21H,23H-porphyrinatozinc crystals of a crystal form having peaks at 9.4°, 14.2° and 22.2° of Bragg's angle (2θ±0.2°) in the CuKα characteristic X-ray diffraction (Crystals A), 5,10,15,20-tetra(4-pyridyl)-21H,23H-porphyrinatozinc crystals of a crystal form having peaks at 7.0°, 10.5°, 17.8° and 22.4° of Bragg's angle (2θ±0.2°) in the CuKα characteristic X-ray diffraction (Crystals B), 5,10,15,20-tetra(4-pyridyl)-21H,23H-porphyrinatozinc crystals of a crystal form having peaks at 7.4°, 10.2° and 18.3° of Bragg's angle (2θ±0.2°) in the CuKα characteristic X-ray diffraction (Crystals C), and 5,10,15,20-tetra(4-pyridyl)-21H,23H-porphyrinatozinc crystals of a crystal form having peaks at 9.1°, 10.6°, 11.2° and 14.5° of Bragg's angle (2θ±0.2°) in the CuKα characteristic X-ray diffraction (Crystals D).

Preferred exemplary compounds of the azo compound and porphyrin compound used in the present invention are enumerated below. Examples are by no means limited to these. As to structural formulas concerning the azo compound, only moieties corresponding to Ar and Cp of the formula (4) are shown in Tables 1 to 8 as 1-1 to 1-80. Structural formulas concerning the porphyrin compound are shown as (2-1) to (2-14).

TABLE 1

Cp1—N=N—Ar—N=N—Cp2

| Exemplary compound | Ar | Cp1 | Cp2 |
|---|---|---|---|
| 1-1 | 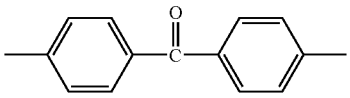 | 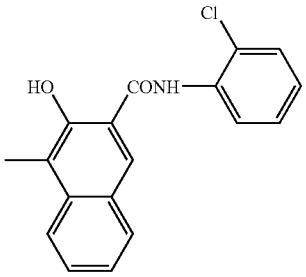 | The same as Cp1 |
| 1-2 | 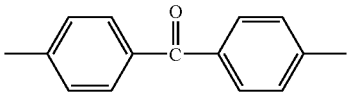 | 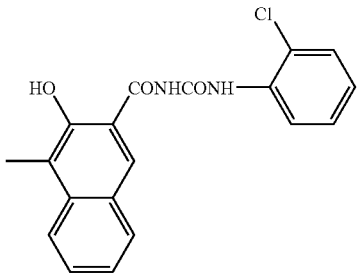 | The same as Cp1 |

TABLE 1-continued
| Exemplary compound | Ar | Cp1 | Cp2 |
|---|---|---|---|
| | | Cp1—N=N—Ar—N=N—Cp2 | |
| 1-3 | 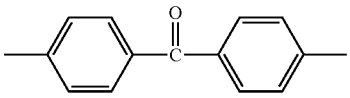 | 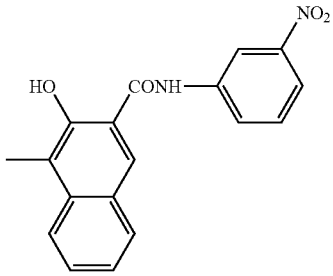 | The same as Cp1 |
| 1-4 | 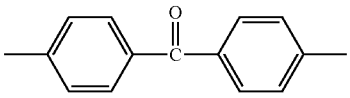 | 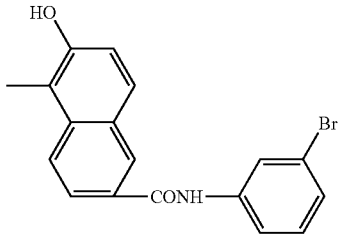 | The same as Cp1 |
| 1-5 | 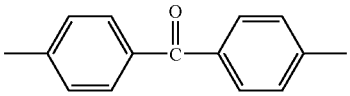 | 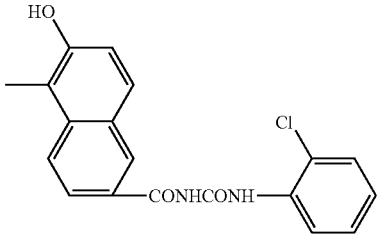 | The same as Cp1 |
| 1-6 | 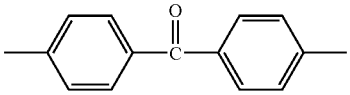 | 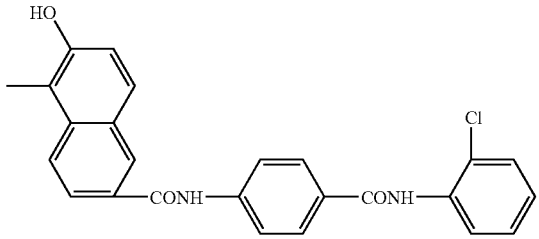 | The same as Cp1 |
| 1-7 | 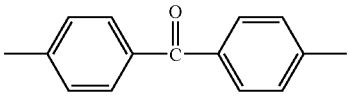 | 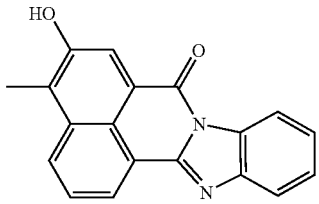 | The same as Cp1 |
| 1-8 | 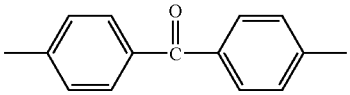 | 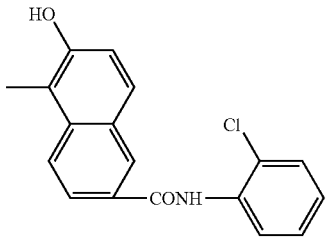 | The same as Cp1 |

TABLE 1-continued
Cp1—N=N—Ar—N=N—Cp2
| Exemplary compound | Ar | Cp1 | Cp2 |
|---|---|---|---|
| 1-9 | 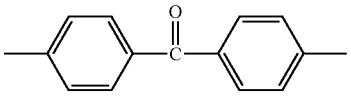 | 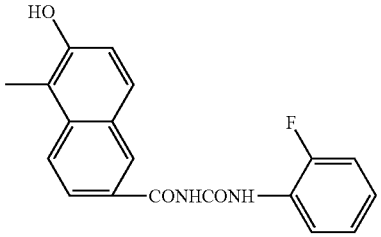 | The same as Cp1 |
| 1-10 | 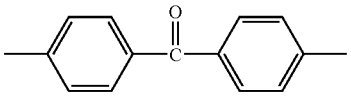 | 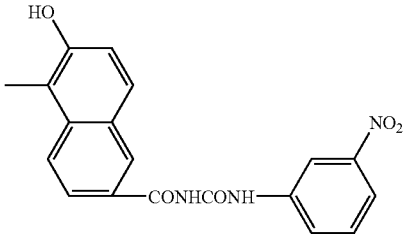 | The same as Cp1 |
TABLE 2
Cp1—N=N—Ar—N=N—Cp2
| Exemplary compound | Ar | Cp1 | Cp2 |
|---|---|---|---|
| 1-11 | 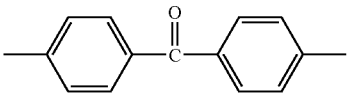 | 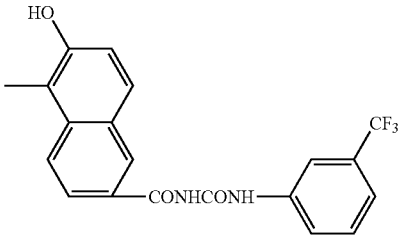 | The same as Cp1 |
| 1-12 | 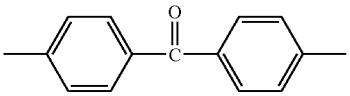 | 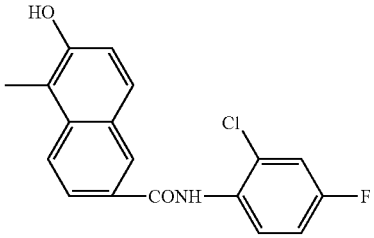 | The same as Cp1 |
| 1-13 | 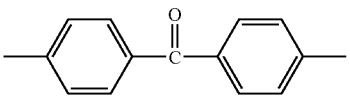 | 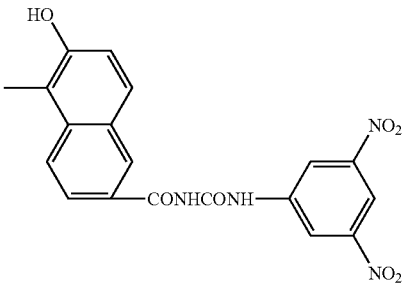 | The same as Cp1 |

TABLE 2-continued
Cp1—N=N—Ar—N=N—Cp2
| Exemplary compound | Ar | Cp1 | Cp2 |
|---|---|---|---|
| 1-14 | 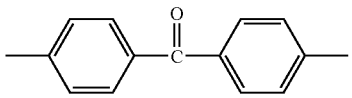 | 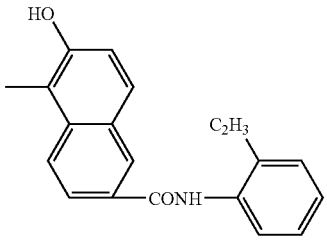 | The same as Cp1 |
| 1-15 | 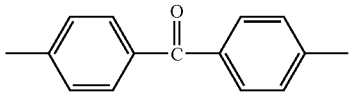 | 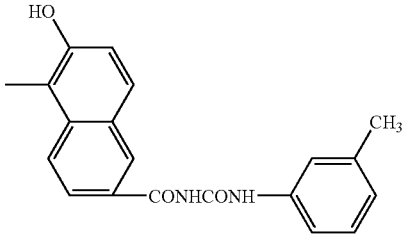 | The same as Cp1 |
| 1-16 | 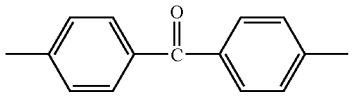 | 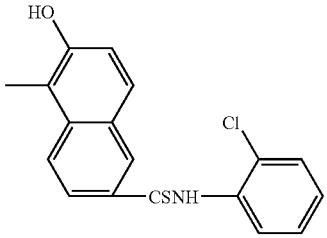 | The same as Cp1 |
| 1-17 | 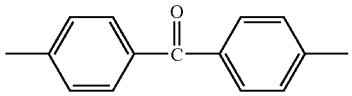 | 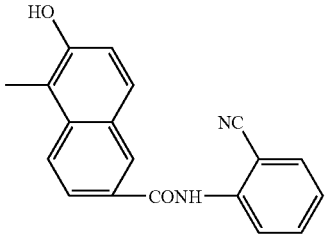 | The same as Cp1 |
| 1-18 | 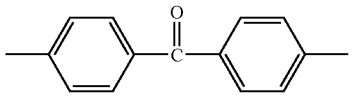 | 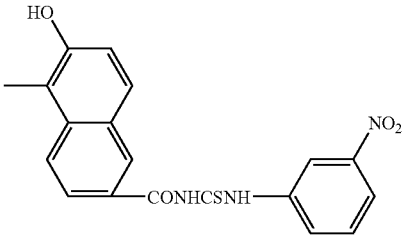 | The same as Cp1 |

TABLE 2-continued
| Exemplary compound | Ar | Cp1 | Cp2 |
|---|---|---|---|
| | Cp1—N=N—Ar—N=N—Cp2 | | |
| 1-19 | 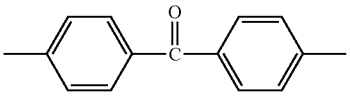 | 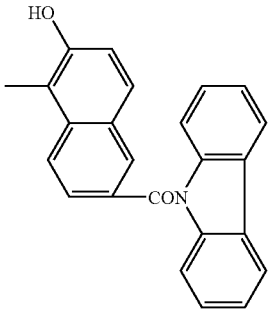 | The same as Cp1 |
| 1-20 | 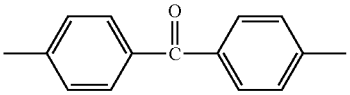 | 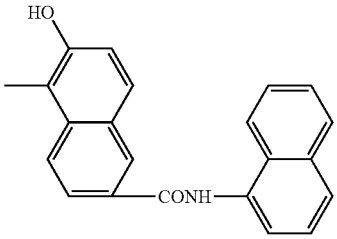 | The same as Cp1 |
TABLE 3
| Exemplary compound | Ar | Cp1 | Cp2 |
|---|---|---|---|
| | Cp1—N=N—Ar—N=N—Cp2 | | |
| 1-21 | 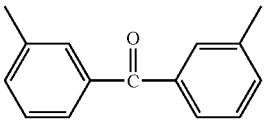 | 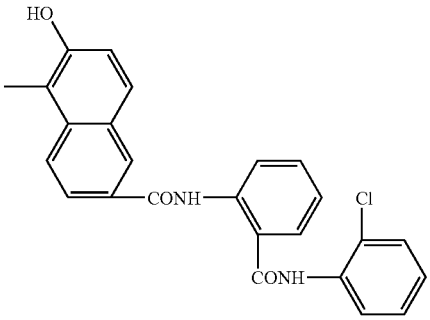 | The same as Cp1 |
| 1-22 | 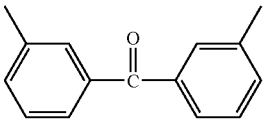 | 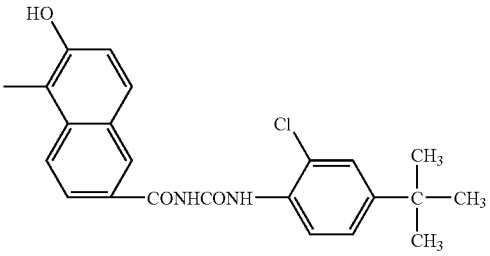 | The same as Cp1 |

TABLE 3-continued
| Exemplary compound | Ar | Cp1 | Cp2 |
|---|---|---|---|
| | Cp1—N=N—Ar—N=N—Cp2 | | |
| 1-23 | 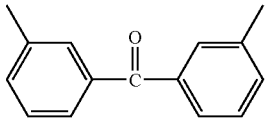 | 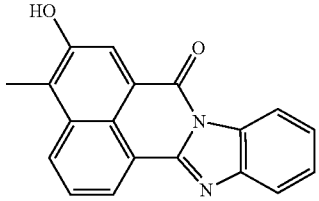 | The same as Cp1 |
| 1-24 | 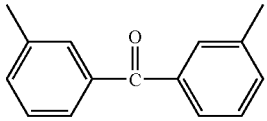 | 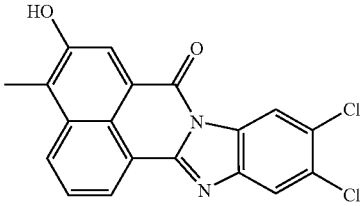 | The same as Cp1 |
| 1-25 | 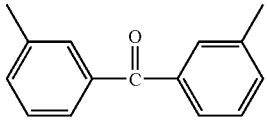 | 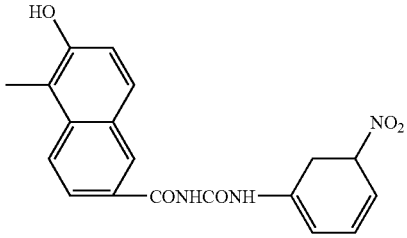 | The same as Cp1 |
| 1-26 | 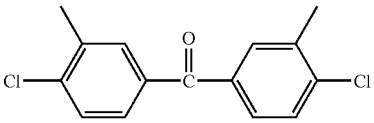 | 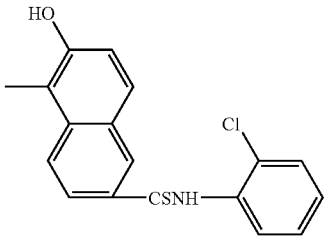 | The same as Cp1 |
| 1-27 | 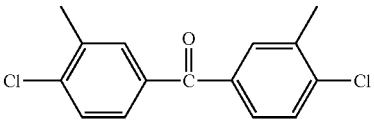 | 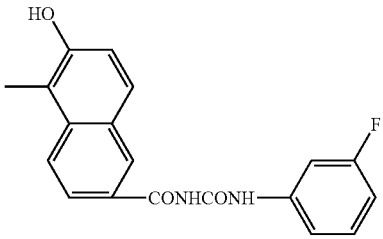 | The same as Cp1 |
| 1-28 | 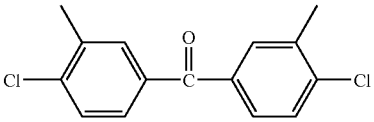 | 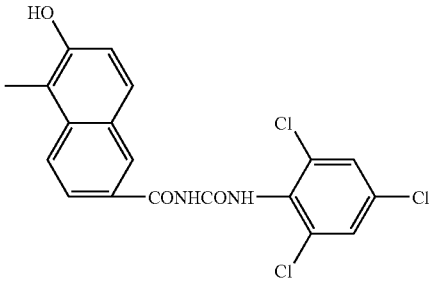 | The same as Cp1 |

TABLE 3-continued
Cp1—N=N—Ar—N=N—Cp2
| Exemplary compound | Ar | Cp1 | Cp2 |
|---|---|---|---|
| 1-29 | 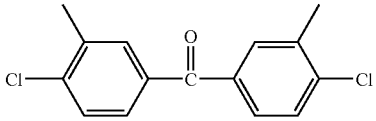 | 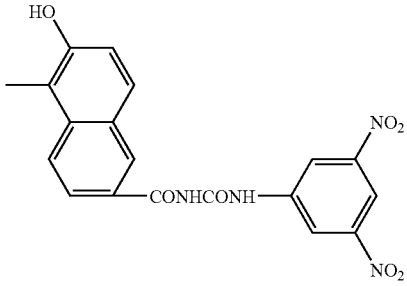 | The same as Cp1 |
| 1-30 | 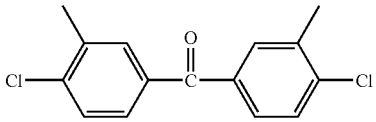 | 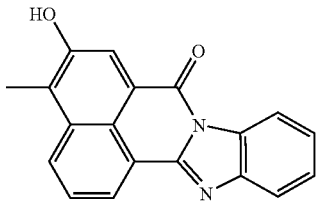 | The same as Cp1 |
TABLE 4
Cp1—N=N—Ar—N=N—Cp2
| Exemplary compound | Ar | Cp1 | Cp2 |
|---|---|---|---|
| 1-31 | 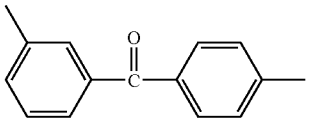 | 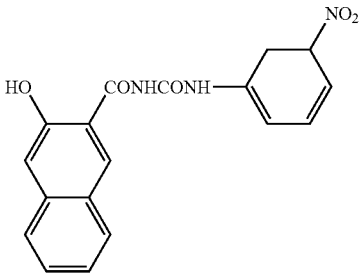 | The same as Cp1 |
| 1-32 | 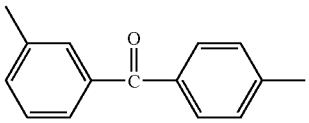 | 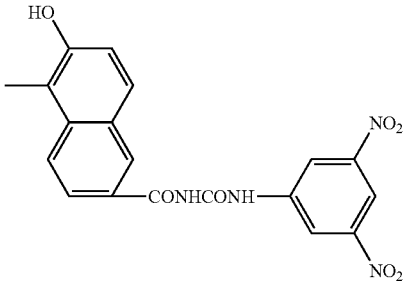 | The same as Cp1 |
| 1-33 | 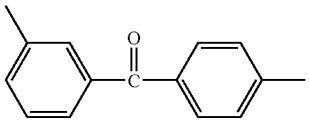 | 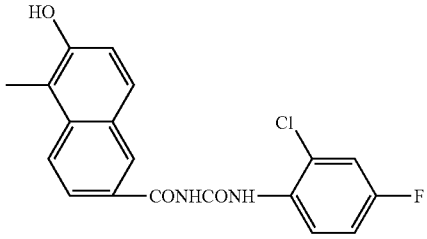 | The same as Cp1 |

TABLE 4-continued
| Exemplary compound | Ar | Cp1 | Cp2 |
|---|---|---|---|
| | | Cp1—N=N—Ar—N=N—Cp2 | |
| 1-34 | 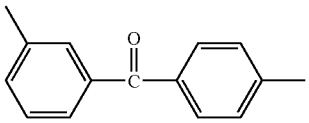 | 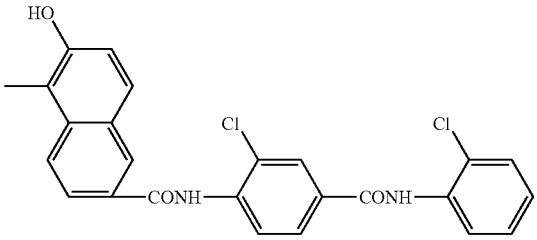 | The same as Cp1 |
| 1-35 | 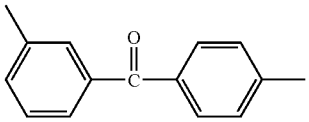 | 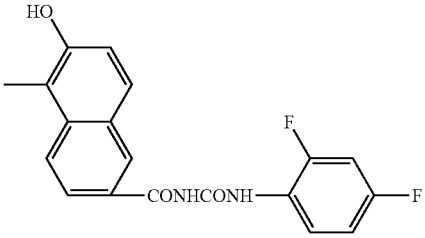 | The same as Cp1 |
| 1-36 | 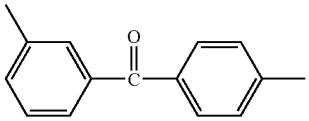 | 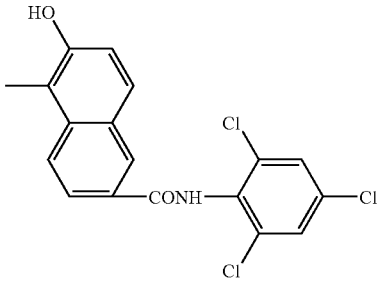 | The same as Cp1 |
| 1-37 | 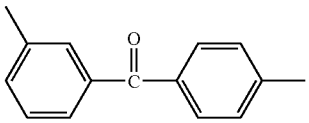 | 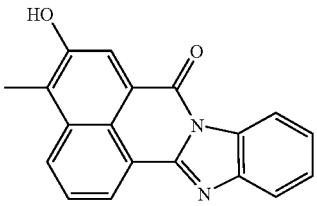 | The same as Cp1 |
| 1-38 | 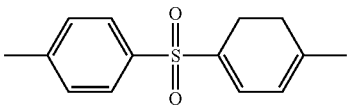 | 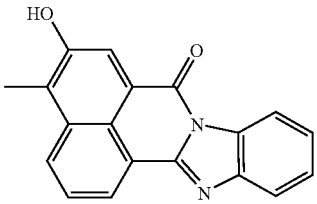 | The same as Cp1 |
| 1-39 | 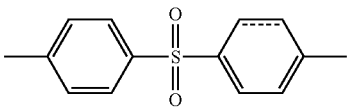 | 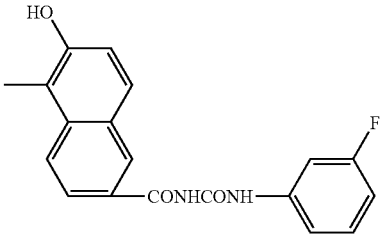 | The same as Cp1 |

TABLE 4-continued
| Exemplary compound | Ar | Cp1 | Cp2 |
|---|---|---|---|
| | Cp1—N=N—Ar—N=N—Cp2 | | |
| 1-40 | 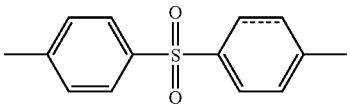 | 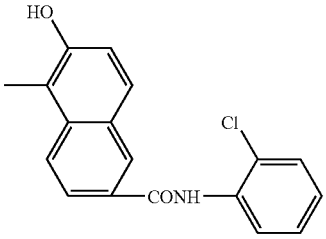 | The same as Cp1 |
TABLE 5
| Exemplary compound | Ar | Cp1 | Cp2 |
|---|---|---|---|
| | Cp1—N=N—Ar—N=N—Cp2 | | |
| 1-41 | 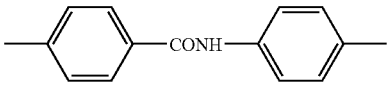 | 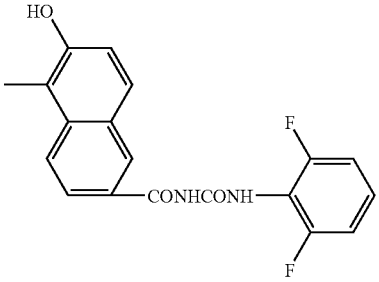 | The same as Cp1 |
| 1-42 | 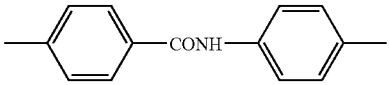 | 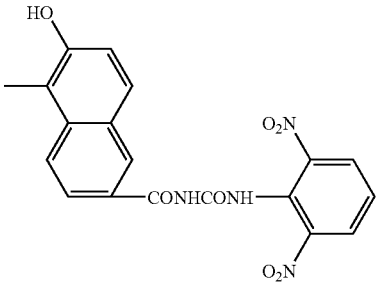 | The same as Cp1 |
| 1-43 | 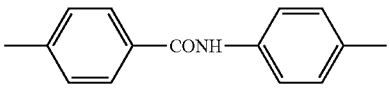 | 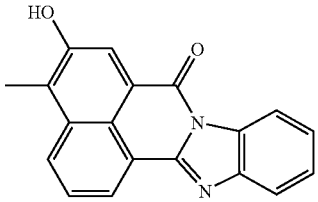 | The same as Cp1 |
| 1-44 | 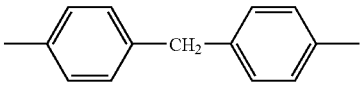 | 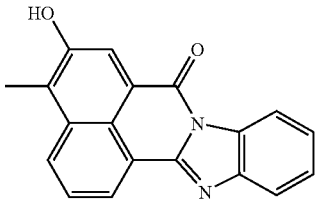 | The same as Cp1 |

TABLE 5-continued
| Exemplary compound | Ar | Cp1 | Cp2 |
|---|---|---|---|
| | Cp1—N=N—Ar—N=N—Cp2 | | |
| 1-45 | 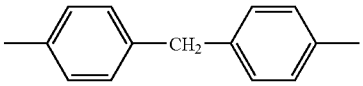 | 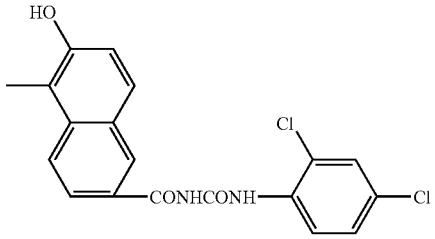 | The same as Cp1 |
| 1-46 | 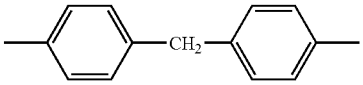 | 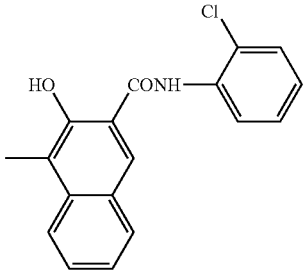 | The same as Cp1 |
| 1-47 | 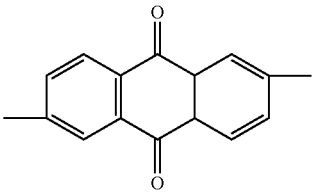 | 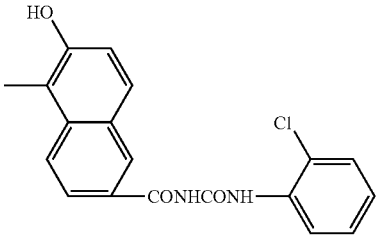 | The same as Cp1 |
| 1-48 | 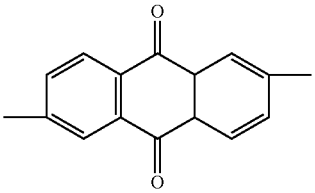 | 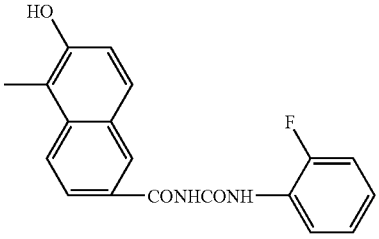 | The same as Cp1 |
| 1-49 | 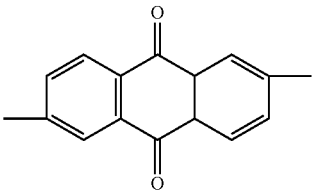 | 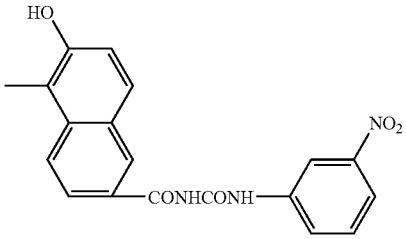 | The same as Cp1 |
| 1-50 | 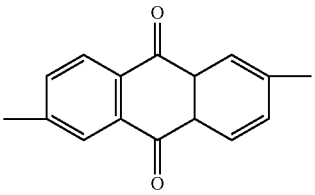 | 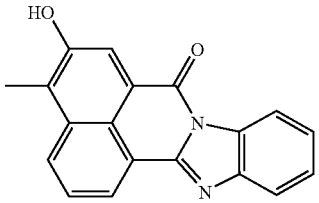 | The same as Cp1 |

TABLE 6
Cp1—N=N—Ar—N=N—Cp2
| Exemplary compound | Ar | Cp1 | Cp2 |
|---|---|---|---|
| 1-51 | 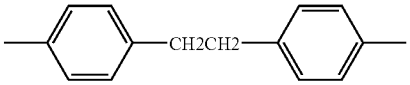 | 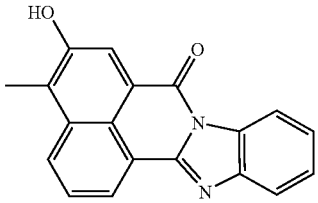 | The same as Cp1 |
| 1-52 | 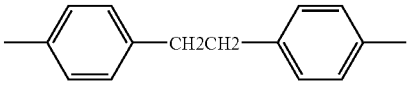 | 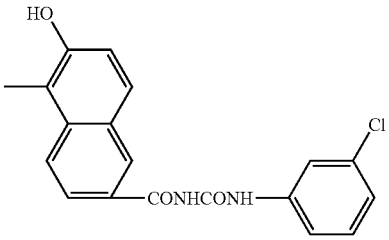 | The same as Cp1 |
| 1-53 | 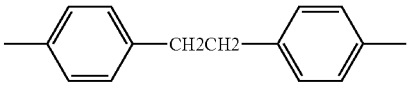 | 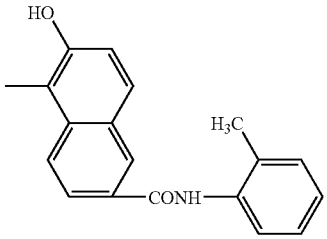 | The same as Cp1 |
| 1-54 | 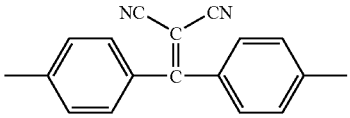 | 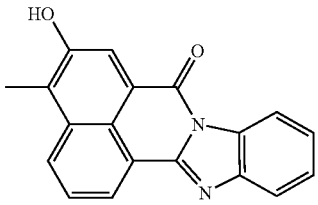 | The same as Cp1 |
| 1-55 | 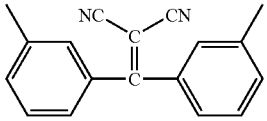 | 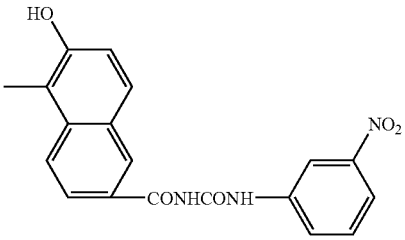 | The same as Cp1 |
| 1-56 | 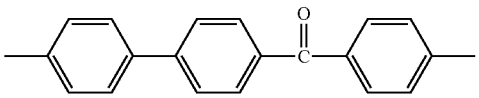 | 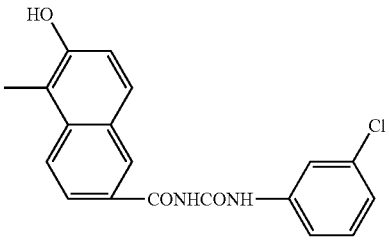 | The same as Cp1 |

TABLE 6-continued
Cp1—N=N—Ar—N=N—Cp2
| Exemplary compound | Ar | Cp1 | Cp2 |
|---|---|---|---|
| 1-57 | 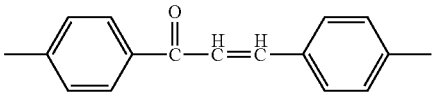 | 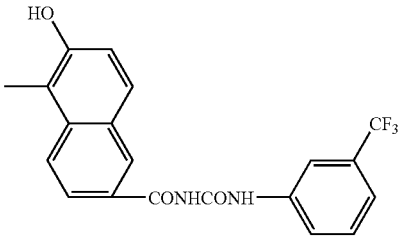 | The same as Cp1 |
| 1-58 | 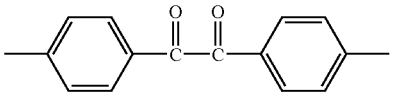 | 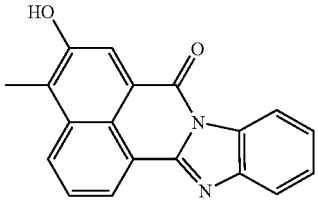 | The same as Cp1 |
| 1-59 | 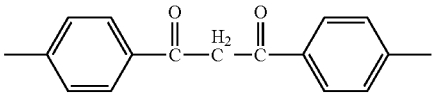 | 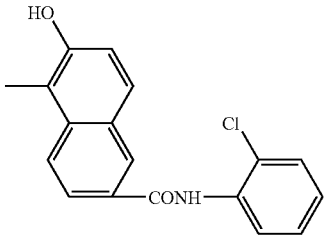 | The same as Cp1 |
| 1-60 | 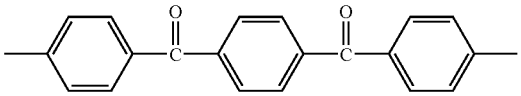 | 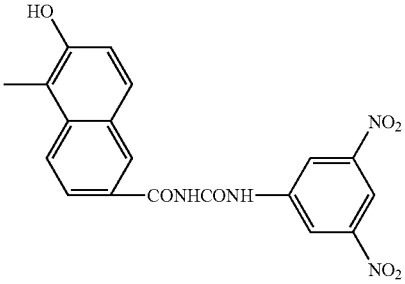 | The same as Cp1 |
TABLE 7
Cp1—N=N—Ar—N=N—Cp2
| Exemplary compound | Ar | Cp1 | Cp2 |
|---|---|---|---|
| 1-61 | 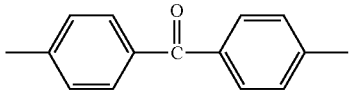 | 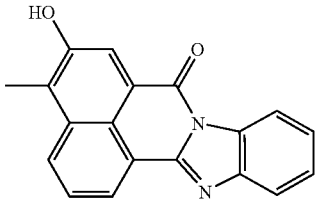 | 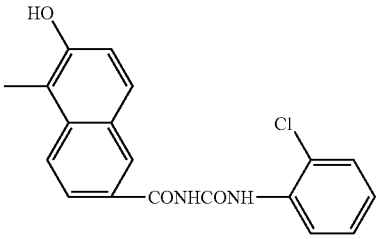 |

TABLE 7-continued
| Exemplary compound | Ar | Cp1 | Cp2 |
|---|---|---|---|
| | | Cp1—N=N—Ar—N=N—Cp2 | |
| 1-62 | 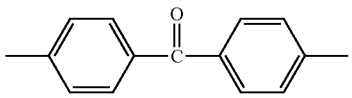 | 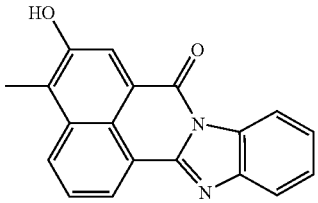 | 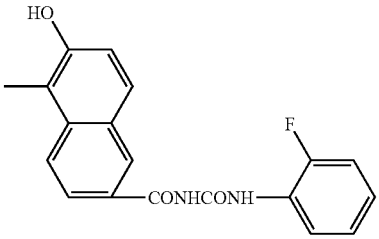 |
| 1-63 | 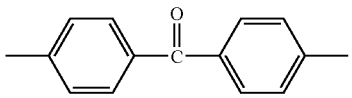 | 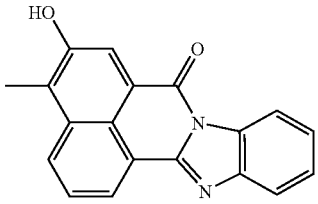 | 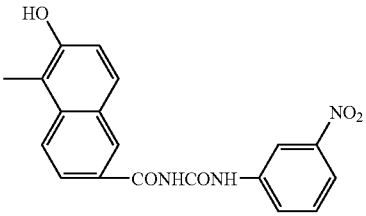 |
| 1-64 | 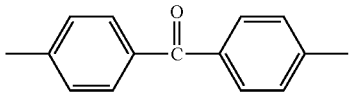 | 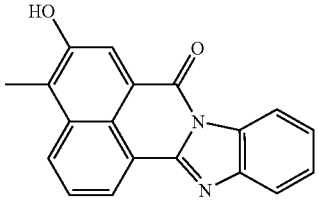 | 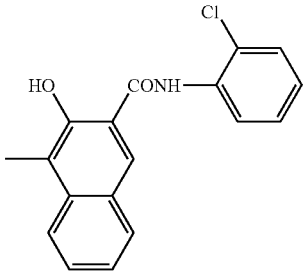 |
| 1-65 | 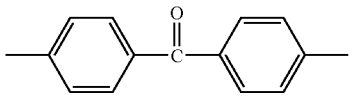 | 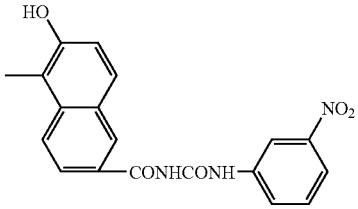 | 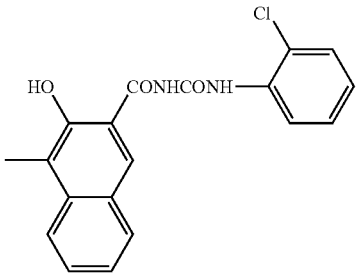 |
| 1-66 | 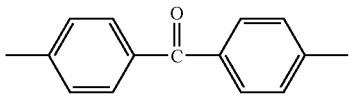 | 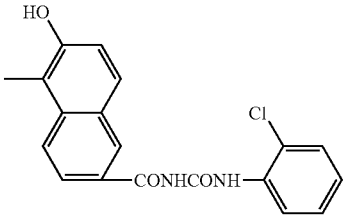 | 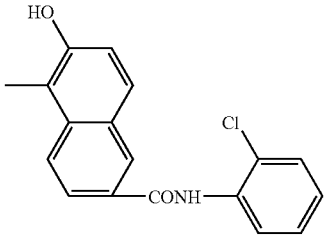 |

TABLE 7-continued
| Exemplary compound | Ar | Cp1 | Cp2 |
|---|---|---|---|
| | Cp1—N=N—Ar—N=N—Cp2 | | |
| 1-67 | 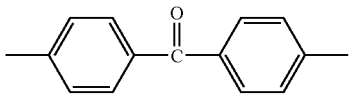 | 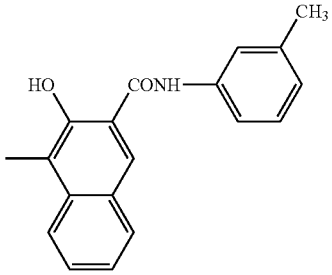 | 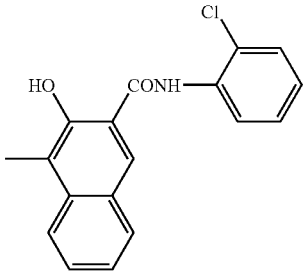 |
| 1-68 | 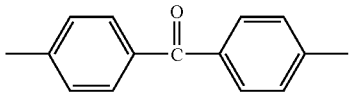 | 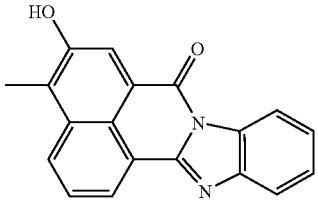 | 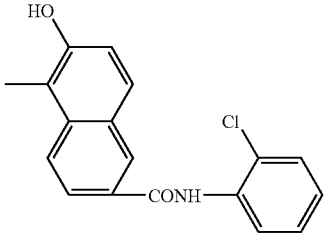 |
| 1-69 | 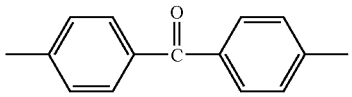 | 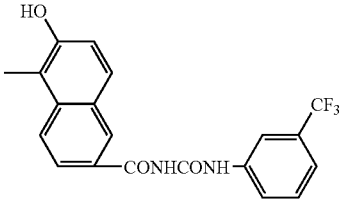 | 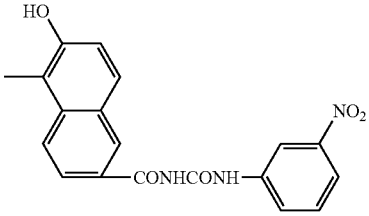 |
| 1-70 | 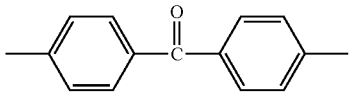 | 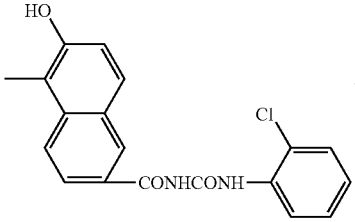 | 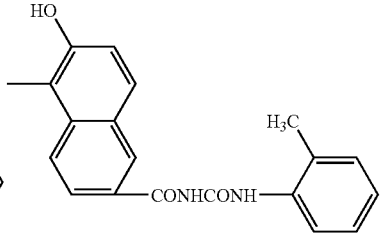 |
TABLE 8
| Exemplary compound | Ar | Cp1 | Cp2 |
|---|---|---|---|
| | Cp1—N=N—Ar—N=N—Cp2 | | |
| 1-71 | 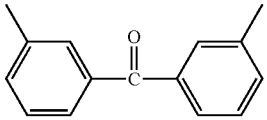 | 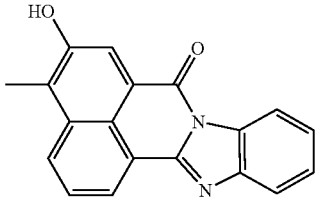 | 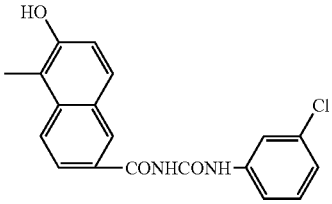 |

TABLE 8-continued
| Exemplary compound | Cp1—N=N—Ar—N=N—Cp2 | | |
|---|---|---|---|
| | Ar | Cp1 | Cp2 |
| 1-72 | 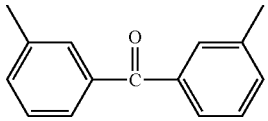 | 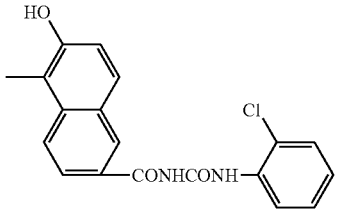 | 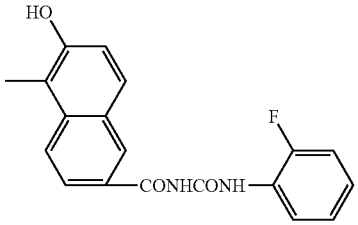 |
| 1-73 | 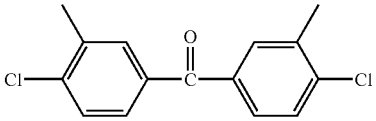 | 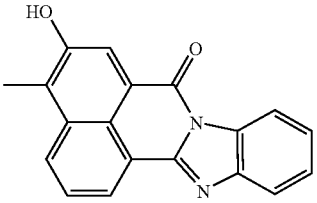 | 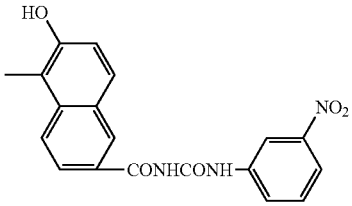 |
| 1-74 | 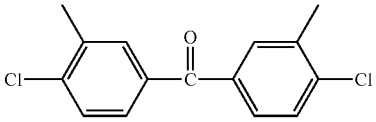 | 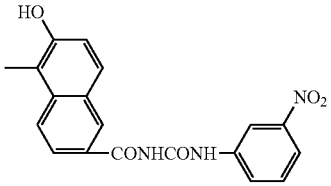 | 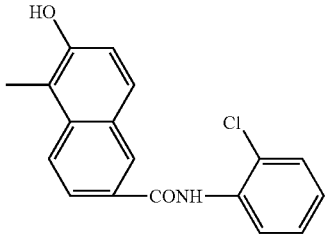 |
| 1-75 | 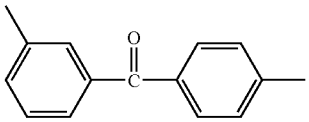 | 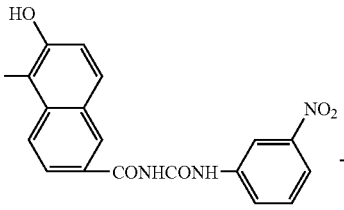 | 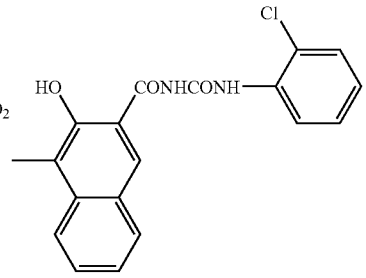 |
| 1-76 | 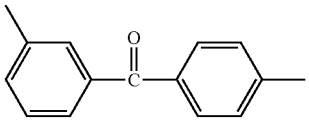 | 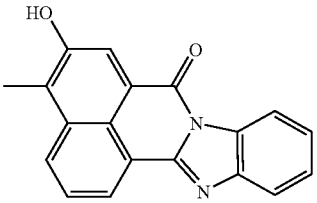 | 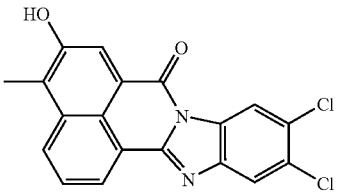 |

TABLE 8-continued
| Exemplary compound | Ar | Cp1 | Cp2 |
|---|---|---|---|
| | Cp1—N=N—Ar—N=N—Cp2 | | |
| 1-77 | 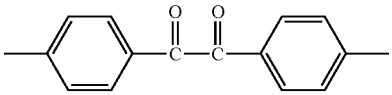 | 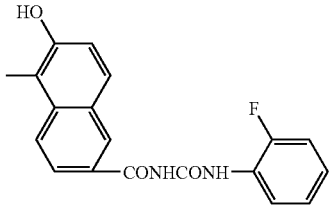 | 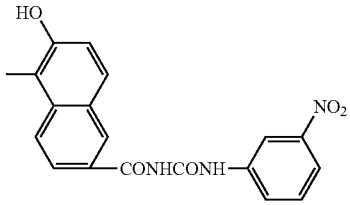 |
| 1-78 | 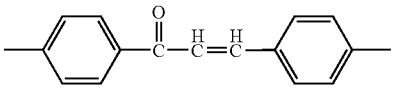 | 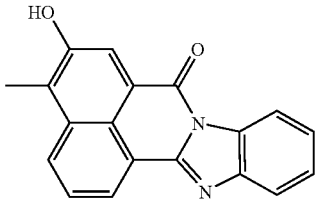 | 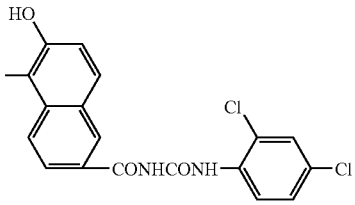 |
| 1-79 | 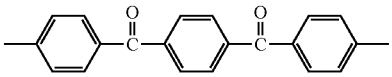 | 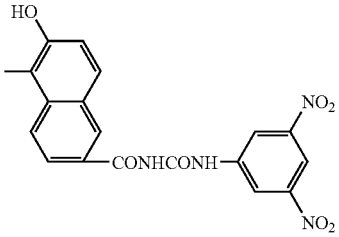 | 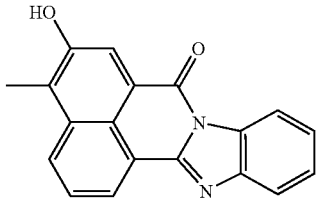 |
| 1-80 | 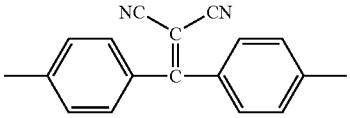 | 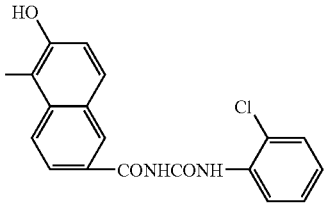 | 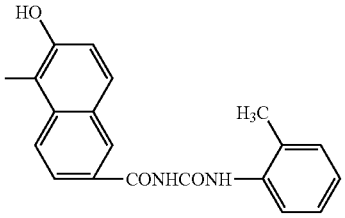 |
(2-1)
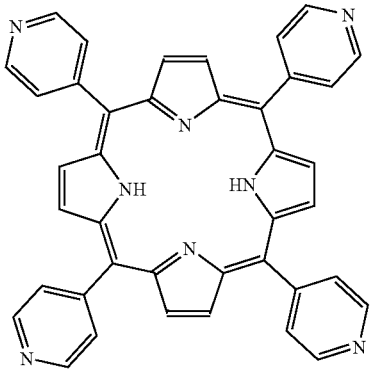
-continued
(2-2)
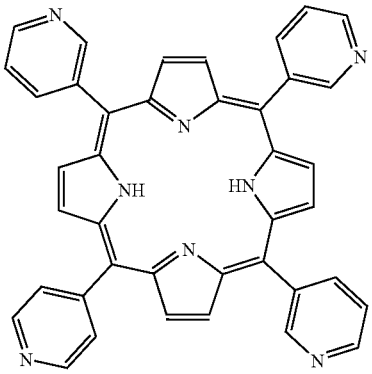

-continued
(2-3)
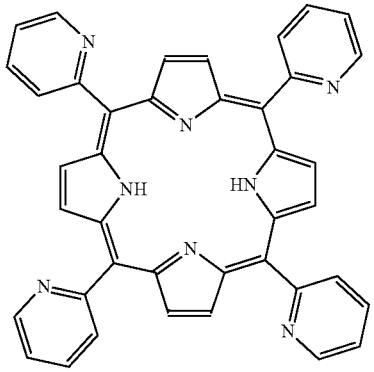
(2-4)
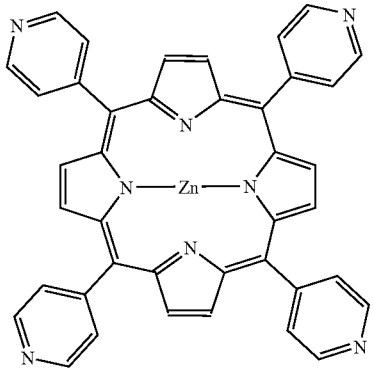
(2-5)
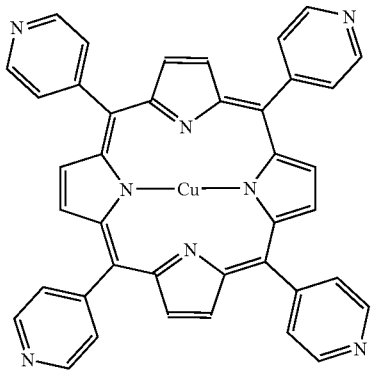
(2-6)
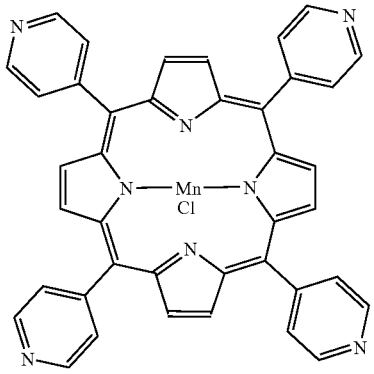
-continued
(2-7)
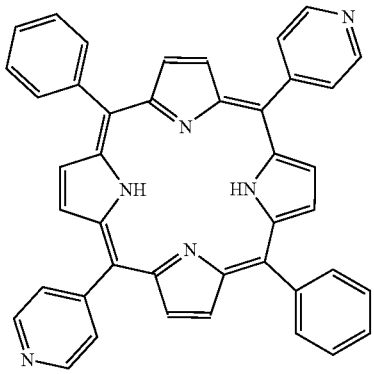
(2-8)
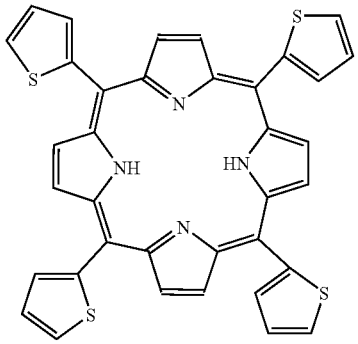
(2-9)
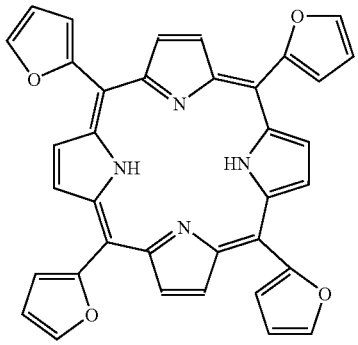
(2-10)
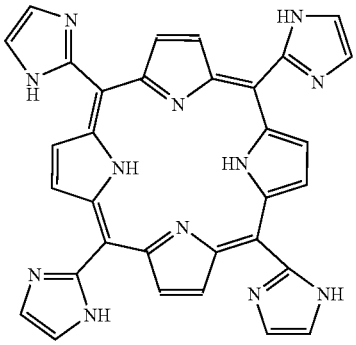

-continued (2-11)

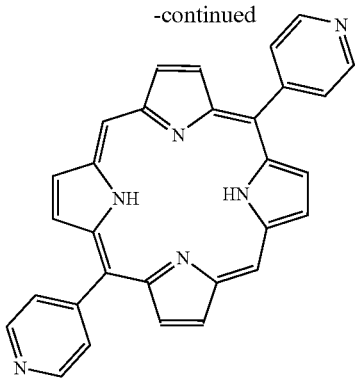

(2-12)

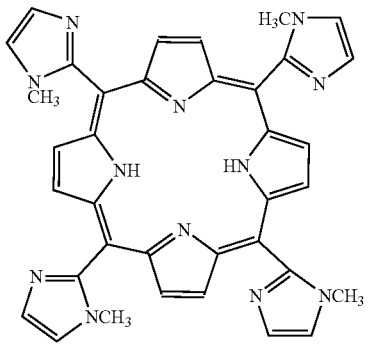

(2-13)

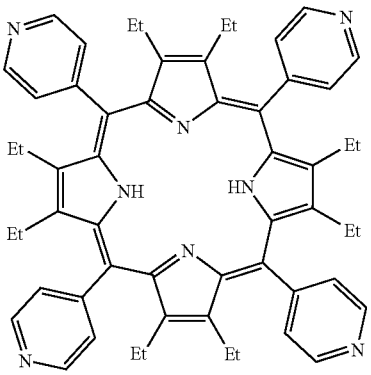

(2-14)

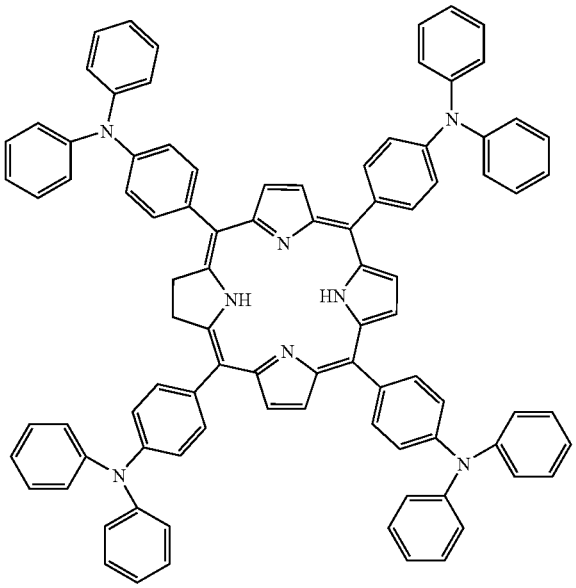

The above azo compound and porphyrin compound may each be used in combination of two or more types, or the azo compound and the porphyrin compound may simultaneously be used in combination. Also optionally usable in the form of a mixture with the above is other charge-generating material including cationic dyes such as pyrylium dyes, thiapyrylium dyes, azulenium dyes, thiacyanine dyes and quinocyanine dyes, squalium salt dyes, azo pigments other than the above azo compound, polycyclic quinone pigments such as anthanthrone pigments, dibenzopyrenequinone pigments and pyranthrone pigments, indigo pigments, quinacridone pigments, perylene pigments and phthalocyanine pigments.

The binder resin used to form the charge generation layer may be selected from comprehensive insulating resins or organic photoconductive polymers. Preferred are polyvinyl butyral, polyvinyl benzal, polyarylates, polycarbonates, polyesters, phenoxy resins, cellulose resins, acrylic resins, and polyurethanes, as well as copolymers of two or more of these. These resins may have a substituent. As the substituent, preferred are a halogen atom, an alkyl group, an alkoxyl group, a nitro group, a cyano group, a trifluoromethyl group and so forth. The binder resin may also preferably be used in an amount of 80% by weight or less, and more preferably 60% by weight or less, based on the total weight of the charge generation layer.

The charge generation layer may be formed by coating a charge generation layer coating dispersion obtained by dispersing the charge-generating material together with the binder resin and a solvent, followed by drying. As a method for dispersion, a method is available which makes use of a homogenizer, ultrasonic waves, a ball mill, a sand mill, an attritor, a roll mill or the like. The charge-generating material and the binder resin may preferably be in a proportion ranging from 1:0.1 to 1:4 (weight ratio).

As the solvent used for the charge generation layer coating dispersion, it may be selected taking account of the binder resin to be used and the solubility or dispersion stability of the charge-generating material. It may include, e.g., ethers such as tetrahydrofuran, 1,4-dioxane and 1,2-dimethoxyethane, ketones such as cyclohexanone, methyl ethyl ketone and pentanone, amines such as N,N-dimethylformamdie, esters such as methyl acetate and ethyl acetate, aromatics such as toluene, xylene and chlorobenzene, alcohols such as methanol, ethanol and 2-propanol, and aliphatic halogenated hydrocarbons such as chloroform, methylene chloride, dichloroethylene, carbon tetrachloride and trichloroethylene.

When the charge generation layer coating solution is coated, coating methods as exemplified by dip coating, spray coating, spinner coating, roller coating, Mayer bar coating and blade coating may be used.

The charge generation layer may also preferably be in a layer thickness of 5 μm or less, and particularly more preferably from 0.1 μm to 2 μm.

To the charge generation layer, a sensitizer, an antioxidant, an ultraviolet absorber, a plasticizer, a thickening agent and so forth which may be of various types may also optionally be added.

A charge transport layer is provided on the charge generation layer.

The charge transport layer has the function to receive charged carriers from the charge generation layer in the presence of an electric field and transport the same. The charge transport layer may be formed by coating a coating solution prepared by dissolving a charge-transporting material in a solvent together with a binder resin, followed by drying. It may preferably be in a layer thickness of from 5 μm to 40 μm, more preferably from 5 μm to 30 μm, and still more preferably from 5 μm to 20 μm.

The charge-transporting material includes an electron-transporting material and a hole-transporting material.

The electron-transporting material may include, e.g., electron-attracting substances such as 2,4,7-trinitrofluorenone, 2,4,5,7-tetranitrofluorenone, chloranil and tetracyanoquinodimethane, and those obtained by polymerizing these electron-attracting substances.

The hole-transporting material may include, e.g., polycyclic aromatic compounds such as pyrene and anthracene, heterocyclic compounds such as carbazole compounds, indole compounds, oxazole compounds, thiazole compounds, oxadiazole compounds, pyrazole compounds, pyrazoline compounds, thiadiazole compounds and triazole compounds, hydrazone compounds, styryl compounds, benzidine compounds, triarylmethane compounds, and triphenylamine compounds.

Any of these charge-transporting materials may be used alone or in combination of two or more types.

Where the charge-transporting material has no film-forming properties, a suitable binder resin may be used. The binder resin used for the charge transport layer may include, e.g., insulating resins such as acrylic resins, polyarylates, polycaronates, polyesters, polystyrene, an acrylonitrile-styrene copolymer, polyacrylamide, polyamide and chlorinated rubber, and organic photoconductive polymers such as poly-N-vinyl carbazole and polyvinyl anthracene. One or two or more of any of these may be used alone or in the form of a mixture or copolymer.

A photoconductive resin may also be used which functions as both the charge-transporting material and the binder resin, such as a polymer (e.g., poly-N-vinyl carbazole, polyvinyl anthracene) having in the backbone chain or side chain a group derived from the above charge-transporting material.

However, in the case when the photosensitive layer has the layer configuration as shown in FIG. 1 in which the charge generation layer and the charge transport layer are superposed on the support in this order and such one is used in the electrophotographic photosensitive member, it is necessary to select a charge-transporting material and a binder resin which have high transmittance in respect to the lasing wavelength of the semiconductor laser to be used.

As the solvent used in the charge transport layer coating solution, usable are ketones such as acetone and methyl ethyl ketone, ethers such as tetrahydrofuran and dimethoxymethane, esters such as methyl acetate and ethyl acetate, aromatic hydrocarbons such as toluene and xylene, and hydrocarbons substituted with a halogen atom, such as chlorobenzene, chloroform and carbon tetrachloride.

When the charge transport layer coating solution is coated, coating methods as exemplified by dip coating, spray coating, spinner coating, roller coating, Mayer bar coating and blade coating may be used.

To the charge transport layer, an antioxidant, an ultraviolet absorber, a plasticizer, a filler and so forth may also optionally be added.

In the case when the photosensitive layer is of a single-layer type, such a single-layer type photosensitive layer may be formed by coating a single-layer type photosensitive layer coating dispersion obtained by dispersing the charge-generating material and the charge-transporting material together with the binder resin and the solvent, followed by drying.

A protective layer may also be provided on the photosensitive layer, for the purpose of protecting the photosensitive layer from mechanical external force, chemical external force and so forth and also for the purpose of improving transfer performance and cleaning performance.

The protective layer may be formed by coating a protective layer coating solution obtained by dissolving a resin such as polyvinyl butyral, polyester, polycarbonate, polyamide, polyimide, polyarylate, polyurethane, a styrene-butadiene copolymer, a styrene-acrylic acid copolymer or a styrene-acrylonitrile copolymer in a solvent, followed by drying.

In order to make the protective layer have charge transport performance together, the protective layer may also be formed by curing a monomer material having charge transport performance, or a polymer type charge-transporting material, by cross-linking reaction of various types. The reaction by which it is cured may include radical polymerization, ion polymerization, thermal polymerization, photopolymerization, radiation polymerization (electron ray polymerization), plasma-assisted CVD and photo-assisted CVD.

The protective layer may further be incorporated with conductive particles, an ultraviolet absorbent, a wear resistance improver and so forth. As the conductive particles, metal oxides as exemplified by tin oxide particles are preferred. As the wear resistance improver, fine fluorine resin powders, alumina, silica and the like are preferred.

The protective layer may preferably be in a layer thickness of from 0.5 μm to 20 μm, and particularly preferably from 1 μm to 10 μm.

Figure 4:
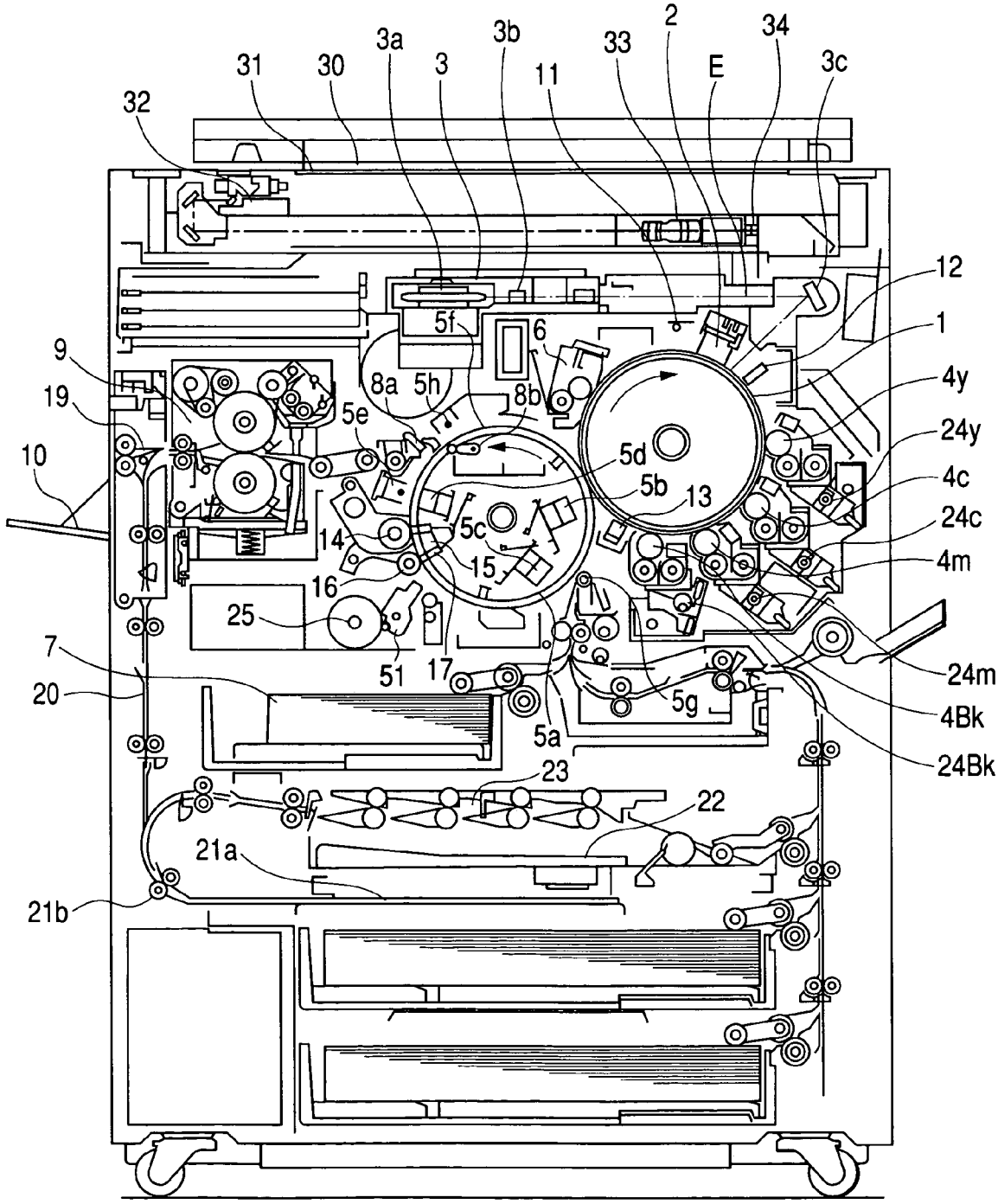
FIG. 4 is a sectional view of a full-color image forming apparatus used in Example 1.

Next, an example of the electrophotographic apparatus of the present invention is shown in FIG. 4 as a schematic sectional view. What is shown in FIG. 4 is a full-color electrophotographic apparatus, which has a digital full-color-image reader section at the top and a digital full-color-image printer section at a lower part.

In the reader section, an original 30 is placed on an original-setting glass 31, and an exposure lamp 32 is put into exposure scanning, whereby an optical image reflected from the original 30 is focused on a full-color sensor 34 through a lens 33 to obtain full-color color separation image signals. The full-color color separation image signals are processed by a video processing unit (not shown) through an amplifying circuit (not shown), and then forwarded to the printer section.

In the printer section, reference numeral 1 denotes an organic photosensitive member, which is supported rotatably in the direction of an arrow. Around the organic photosensitive member 1, provided are an LED 11 (destaticizing means), a corona charging assembly 2 (charging means), a laser exposure optical system 3 (exposure means), a potential sensor 12, different color, four developing assemblies 4*y*, 4*c*, 4*m* and 4Bk (developing means), a detecting means 13 for detecting the amount of light on the surface of the organic photosensitive member, a transfer means 5, and a cleaner 6 (cleaning means).

In the laser exposure optical system 3, the image signals sent from the reader section are converted in a laser output section (not shown) into optical signals for image scanning exposure, and the laser beam thus converted is reflected on a polygonal mirror 3*a* and projected on the surface of the organic photosensitive member 1 through a lens 3*b* and a mirror 3*c*. Writing pitch is set to about 400 dpi to about 2,400 dpi; and the beam spot diameter, to about 15 μm to 40 μm.

At the time of image formation in the printer section, the organic photosensitive member 1 is rotated in the direction of the arrow. The organic photosensitive member 1 is, after destaticized by the LED 11, uniformly negatively electrostatically charged by means of the charging assembly 2, and then irradiated with an optical image E for each separated color to form electrostatic latent images on the surface of the organic photosensitive member 1.

Next, a stated developing assembly is operated to develop the electrostatic latent images formed on the surface of the organic photosensitive member 1, to form developed images on the surface of the organic photosensitive member 1 by the use of a one-component developer (a toner) or two-component developer (each making use of a negative toner) composed of a resin as a base material. The developing assemblies are so set as to alternatively come close to the organic photosensitive member 1 in accordance with the respective separated colors by the operation of eccentric cams 24*y*, 24*c*, 24*m* and 24Bk.

Developed images held on the surface of the organic photosensitive member 1 are further transferred to a sheet of paper (transfer material) which has been fed from a transfer material cassette 7 in which sheets of paper which are transfer materials are kept held, through a transport system and the transfer means 5 and to the position facing the organic photosensitive member 1.

The transfer means 5 has, in this example, a transfer drum 5*a*, a transfer charging assembly 5*b*, an attraction charging assembly 5*c* for attracting a sheet of paper (transfer material) electrostatically, an attraction roller 5*g* provided opposingly thereto, an inside charging assembly 5*d*, and an outside charging assembly 5*e*. The transfer drum 5*a*, which is axially supported so that it can rotatingly be driven, has a transfer material holding sheet 5*f* made of a dielectric material, which is stretched integrally in a cylindrical form at an open zone on the periphery thereof. As the transfer material holding sheet 5*f*, a dielectric-material sheet such as polycarbonate film is used.

As the transfer drum 5*a* is rotated, the developed images on the surface of the organic photosensitive member 1 are transferred by means of the transfer charging assembly 5*b* to the sheet of paper (transfer material) held on the transfer material holding sheet 5*f* of the transfer drum 5*a*.

In this way, a desired number of color images are transferred to the sheet of paper (transfer material) held on the transfer material holding sheet 5*f*, thus a full-color image is formed.

In the case when the full-color image is formed, the transfer of four-color developed images is thus completed, whereupon the sheet of paper (transfer material) is separated from the transfer drum 5*a* by the action of a separation claw 8*a*, a separation push-up roller 8*b* and a separation charging assembly 5*h*, and then put out to a tray 10 via a heat roller fixing assembly 9.

Meanwhile, the organic photosensitive member 1 after transfer is cleaned by removing with the cleaner 6 the toners remaining on the surface, and thereafter again put to the steps of image formation.

When the image is formed on the both sides of the sheet of paper (transfer material), immediately after the paper has been delivered out of the fixing assembly 9, a transport path switch guide 19 is driven to first guide the paper to a reverse path 21*a* via a transport vertical path 20, and then reverse rollers 21*b* are rotated in reverse so that the sheet of paper is withdrawn in the direction opposite to the direction in which it has been sent into the rollers, with its leading end first which had been the rear end when sent into the rollers, and is received in an intermediate tray 22. Thereafter, an image is formed again on the other side through the image formation steps described above.

In order to, e.g., prevent powder from scattering and adhering onto the transfer material holding sheet 5*f* of the transfer drum 5*a* and prevent oil from adhering onto the paper (transfer material), cleaning is also performed by the action of a fur brush 14 and a back-up brush 15 set opposingly to the fur brush 14 via the transfer material holding sheet 5*f*, and an oil-removing roller 16 and a back-up brush 17 set opposingly to the oil-removing roller 16 via the transfer material holding sheet 5*f*. Such cleaning may be performed before the image formation or after the image formation, or may be performed at any time when a jam (paper jam) occurs.

In this example, an eccentric cam 25 is also operated at desired timing to actuate a cam follower 5*i* associated with the transfer drum 5*a*, whereby the gap between the transfer material holding sheet 5*f* and the organic photosensitive member 1 can be set as desired. For example, during a stand-by or at the time of power-off, a space is kept between the transfer drum 5*a* and the organic photosensitive member 1.

A developer (toner) used in the electrophotographic apparatus of the present invention is described next.

The toner used in the present invention may preferably have a specific particle size distribution. If toner particles of 5 μm or less in particle diameter are less than 17% by number, the toner tends to be consumed in a large quantity. In addition, if the toner has a volume-average particle diameter Dv (μm) of 8 μm or more and a weight-average particle diameter D4 (μm) of 9 μm or more, the resolution of dots of 100 μm or less in diameter tends to lower, and this tendency is more remarkable in regard to the resolution of dots of 20 to 40 μm that is achievable in the present invention. In such a case, even if it is attempted to perform development according to unnatural designing under different development conditions, it is difficult to achieve stable developing performance, such that thick-line images or toner scatter tends to occur or the toner may be consumed in a large quantity. If on the other hand toner particles of 5 μm or less in particle diameter are more than 90% by number, it may be difficult to perform development stably, to cause a difficulty such that the image density decreases. In order to more improve resolution, the toner may preferably be a toner having fine particle diameter of $3.0\ \mu m \leqq Dv \leqq 6.0\ \mu m$ and $3.5\ \mu m \leqq D4 \leqq 6.5\ \mu m$, which may further preferably be $3.2\ \mu m \leqq Dv \leqq 5.8\ \mu m$ and $3.6\ \mu m \leqq D4 \leqq 6.3\ \mu m$.

As a binder resin used in the toner, it may include styrene homopolymers or copolymers such as polystyrene, a styrene-acrylate copolymer, a styrene-methacrylate copolymer and a styrene-butadiene copolymer, polyester resins, epoxy resins, and petroleum resins.

In view of an improvement in releasability from a fixing member and an improvement in fixing performance at the time of fixing, it is preferable to incorporate in the toner such a wax as shown below. The wax may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives include oxides, block copolymers with vinyl monomers, and graft modified products. Besides, also usable are long-chain alcohols, long-chain fatty acids, acid amide compounds, ester compounds, ketone compounds, hardened caster oil and derivatives thereof, vegetable waxes, animal waxes, mineral waxes and petrolatum.

As a colorant used in the toner, an inorganic pigment, an organic dye and an organic pigment which are conventionally known may be used. It may include, e.g., carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may usually be used in an amount of from 0.5 to 20 parts by weight based on 100 parts by weight of the binder resin.

A magnetic material may also be used as a component constituting the toner. The magnetic material may include magnetic metal oxides containing an element such as iron, cobalt, nickel, copper, magnesium, manganese, aluminum or silicon. Of these, those composed chiefly of a magnetic iron oxide such as triion tetraoxide and γ-iron oxide are preferred.

For the purpose of charge control of the toner, also usable are a Nigrosine dye, a quaternary ammonium salt, a salicylic acid metal complex, a salicylic acid metal salt, a salicylic acid derivative metal complex, salicylic acid, acetylacetone and the like.

The toner used in the full-color electrophotographic apparatus of the present invention may preferably have an inorganic fine powder on toner particle surfaces. This is effective for improving development efficiency, reproducibility of electrostatic latent images, and transfer efficiency, and making fog less occur.

The inorganic fine powder may include, e.g., fine powders formed of colloidal silica, titanium oxide, iron oxide, aluminum oxide, magnesium oxide, calcium titanate, barium titanate, strontium titanate, magnesium titanate, cerium oxide, zirconium oxide or the like. One or two or more of any of these may be used alone or in the form of a mixture. Of these, fine powders of oxides such as titania, alumina and silica or double oxides are preferred.

Such inorganic fine powder may also preferably be one having been subjected to hydrophobic treatment. In particular, the inorganic fine powder may preferably be one having been subjected to surface treatment with a silane coupling agent or a silicone oil. As methods for such hydrophobic treatment, available are a method in which the inorganic fine powder is treated with an organometallic compound such as a silane coupling agent or a titanium coupling agent, capable of reacting with or physically adsorptive to the former, and a method in which the inorganic fine powder is treated with an organosilicon compound such as silicone oil after it has been treated with a silane coupling agent or while it is treated with a silane coupling agent.

The inorganic fine powder may preferably be one having a BET specific surface area of 30 $m^2/g$ or more, and particularly within the range of from 50 to 400 $m^2/g$, according to nitrogen adsorption as measured by the BET method.

The inorganic fine powder having been hydrophobic-treated may preferably be used in an amount of from 0.01 to 8 parts by weight, more preferably from 0.1 to 5 parts by weight, and particularly still more preferably from 0.2 to 3 parts by weight, based on 100 parts by weight of toner particles.

To the toner, other additives may further be added so long as they substantially do not adversely affect the toner. They may include, e.g., lubricant powders such as polytetrafluoroethylene powder, zinc stearate powder and polyvinylidene fluoride powder; abrasives such as cerium oxide powder, silicon carbide powder and strontium titanate powder; fluidity-providing agents such as titanium oxide powder and aluminum oxide powder; anti-caking agents; conductivity-providing agents such as carbon black powder, zinc oxide powder and tin oxide powder; and developing performance improvers such as organic fine particles and inorganic fine particles with polarity reverse to that of the toner.

To produce the toner, known methods may be used. For example, the binder resin, the wax, the metal salt or metal complex, the pigment, dye or magnetic material as a colorant, and optionally the charge control agent and other additives are thoroughly mixed by means of a mixing machine such as a Henschel mixer or a ball mill, and then the mixture obtained is melt-kneaded by means of a heat kneading machine such as a heat roll, a kneader or an extruder to make the resin and so forth melt one another, in which the metal compound and the pigment, dye or magnetic material are made to disperse or dissolve, followed by cooling for solidification and thereafter pulverization and strict classification. Thus, the toner can be obtained. In the step of classification, a multi-division classifier may preferably be used in view of production efficiency.

The toner may also be produced by a method in which a polymerizable monomer, the colorant and so forth are suspended in an aqueous medium and polymerization is carry out to produce toner particles directly, or a method in which fine polymer particles obtained by emulsion polymerization or the like are dispersed in an aqueous medium to make them undergo association and fusing together with the colorant.

In addition, the toner may be used as a magnetic one-component developer or a non-magnetic one-component developer, or may be blended with carrier particles so as to be used as a two-component developer.

As a developing system in the electrophotographic apparatus of the present invention, a system is preferred in which a developer containing the toner comes into contact with the surface of the electrophotographic photosensitive member to perform reversal development. Where a magnetic-brush developing method making use of the toner and a magnetic carrier is used, used as the magnetic carrier is, e.g., magnetic ferrite, magnetite or iron powder, or those obtained by coating these with a resin such as an acrylic resin, a silicone resin or a fluorine resin.

According to the present invention, in the electrophotographic apparatus having the blue (purple) semiconductor laser as a light source, an electrophotographic apparatus can be provided which may cause less running potential variations and enables reproduction of stable images with ultra-high image quality throughout its running.

EXAMPLES

Typical synthesis examples of the azo compound and porphyrin compound used in the present invention are described below.

Synthesis Example 1

(Synthesis of Exemplary Compound 1-10)

700 ml of water, 102.5 ml (1.13 mols) of concentrated hydrochloric acid and 30.0 g (0.14 mol) of 4,4'-diaminobenzophenone were put into a 2-liter beaker, and these were cooled to 0° C. A solution prepared by dissolving 20.48 g (0.30 mol) of sodium nitrite in 51 ml of ion-exchanged water was dropwise added thereto over a period of 23 minutes while it was maintained to a liquid temperature of 0 to 5° C. After the resultant mixture was stirred for 60 minutes, 3.2 g of activated carbon was added thereto, and these were stirred for 5 minutes, followed by suction filtration. The filtrate thus obtained was kept at 0 to 5° C., in the state of which a solution prepared by dissolving 108.6 g (0.99 mol) of sodium borofluoride in 320 ml of ion-exchanged water was dropwise added thereto over a period of 20 minutes with stirring, and thereafter these were stirred for 60 minutes. The crystals thus precipitated were subjected to suction filtration. Next, the filtration product obtained was dispersedly washed for 60 minutes with 1 liter of an aqueous 5% sodium borofluoride solution as it was kept at 0 to 5° C., followed by suction filtration. The filtration product obtained was further dispersedly washed for 60 minutes with a mixed solvent of 180 ml of acetonitrile and 480 ml of isopropyl ether as it was kept at 0 to 5° C., followed by suction filtration. After washing twice with 300 ml of isopropyl ether by means of a filter, the filtration product was dried under reduced pressure at room temperature to obtain a borofluoride (yield: 49.5 g, 85.5%).

Next, 350 ml of N,N-dimethylformamide was put into a 1-liter beaker, and 5.395 g (0.0154 mol) of a compound having the following structural formula (10) was dissolved therein, followed by cooling to a liquid temperature of 0° C. Thereafter, 3.0 g (0.00732 mol) of the borofluoride obtained in the above step was added thereto, and then 1.7 g (0.0168 mol) of N-methylmorpholine was dropwise added over a period of 5 minutes. Thereafter, these were stirred for 2 hours at 0 to 5° C., and further stirred for 1 hour at room temperature, followed by suction filtration. Washing with 200 ml of N,N-dimethylformamide was carried out twice. The filtration product taken out was dispersedly washed for 2 hours with 200 ml of N,N-dimethylformamide three times, and was further dispersedly washed for 2 hours with 200 ml of ion-exchanged water three times, followed by freeze-drying to obtain Exemplary Compound 1-10 (yield: 5.43 g, 87.3%).

(10)

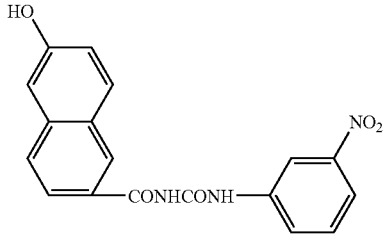

Synthesis Example 2

(Synthesis of Exemplary Compound 2-1)

A three-necked flask was used. Through its two mouths, 4 parts of pyridine-4-aldehyde and 2.8 parts of pyrrole were little by little added using a dropping funnel, to 150 parts of propionic acid kept at reflux. After their addition was completed, the reflux was further continued for 30 minutes. The solvent was evaporated off under reduced pressure, and triethylamine was added to the residue in a very small quantity, followed by purification by silica gel column chromatography (solvent: chloroform) to obtain 1.1 parts of 5,10,15,20-tetra(4-pyridyl)-21H,23H-porphyrin. Values of elementary analysis and data of IR spectrometry of this compound are shown below.

Elementary Analysis:

| | Found | Calculated |
|---|---|---|
| C | 75.7 | 77.7 |
| H | 4.5 | 4.2 |
| N | 17.7 | 18.1 |

IR spectrometry (KBr):

3467, 1593, 1400, 1068, 970 $cm^{-1}$ 5 parts of this compound was dissolved in 150 parts of concentrated sulfuric acid kept at 5° C., and the solution formed was dropwise added to 750 parts of ice water with stirring to effect reprecipitation, followed by filtration. The product obtained was dispersedly washed with ion-exchanged water four times, followed by vacuum drying to obtain 3.5 parts of 5,10,15,20-tetra(4-pyridyl)-21H,23H-porphyrin. The crystals thus obtained were Crystals E having peaks at 8.2°, 19.6°, 20.7° and 25.9° of Bragg's angle (2θ±0.2°) in the CuKα characteristic X-ray diffraction. IR spectrometry thereof showed the same results as that of the compound obtained in the above step.

Figure 5:
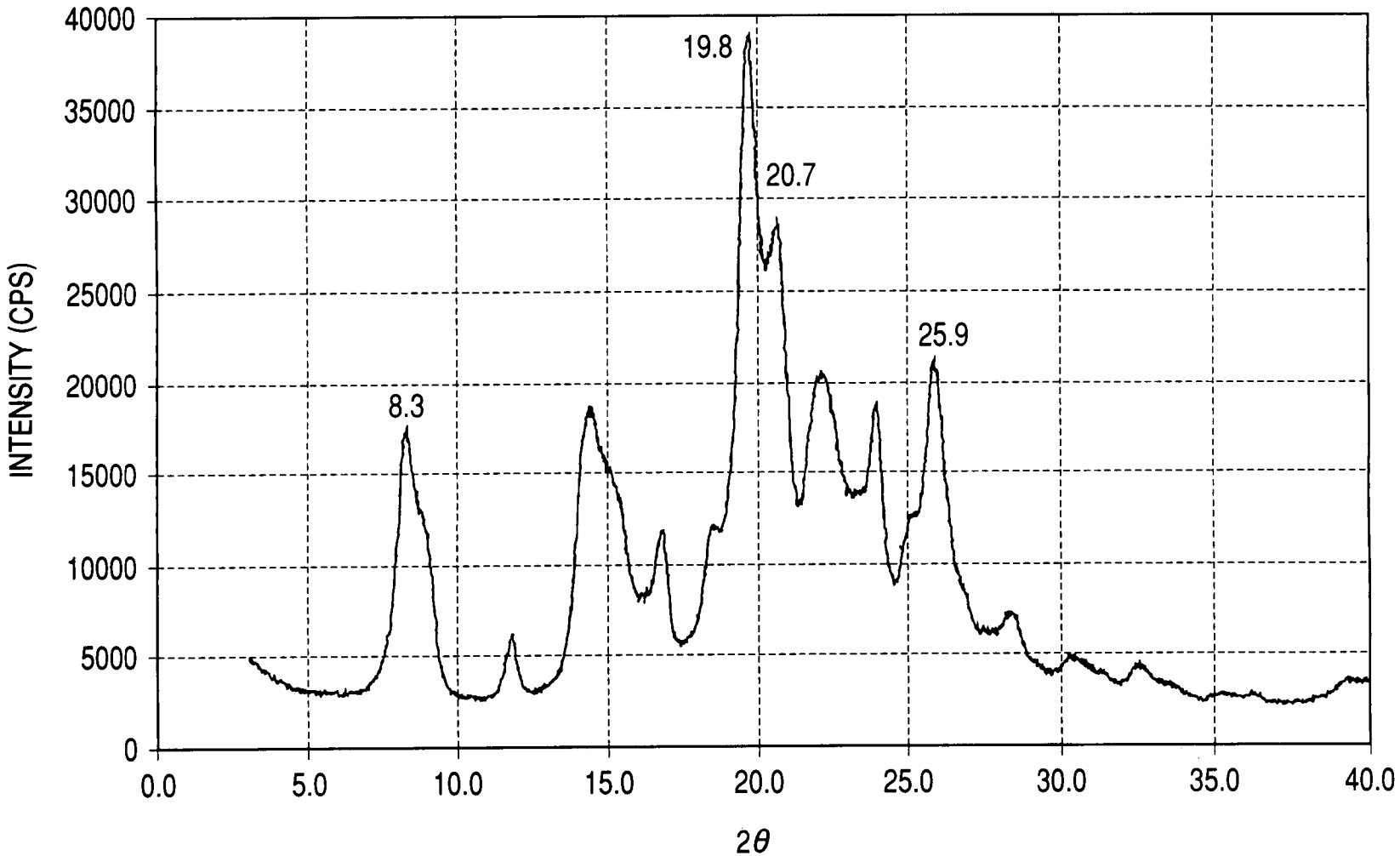
FIG. 5 is a CuKα characteristic X-ray diffraction pattern of 5,10,15,20-tetrapyridyl-21H,23H-porphyrin crystals obtained in Synthesis Example 2.

0.5 part of the above crystals and 15 parts of glass beads of 1 mm in diameter were put to dispersion by means of a paint shaker, followed by water ultrasonication to effect filtration, and then drying. The crystals thus obtained were Crystals E having peaks at 8.3°, 19.8°, 20.7° and 25.9° of Bragg's angle (2θ±0.2°) in the CuKα characteristic X-ray diffraction. An X-ray diffraction pattern thereof is shown in FIG. 5.

Incidentally, the measurement by X-ray diffraction was made using CuKα radiations and under the following conditions.

Measuring instrument used: Full-automatic X-ray diffractometer MXP18, manufactured by Mach Science Co.

X-ray tube: Cu.

Tube voltage: 50 kV.

Tube current: 300 mA.

Scanning method: 2θ/θ scan.

Scanning speed: 2 deg./min.

Sampling interval: 0.020 deg.

Start angle (2θ): 5 deg.

Stop angle (2θ): 40 deg.

Divergent slit: 0.5 deg.

Scattering slit: 0.5 deg.

Receiving slit: 0.3 mm.

Concave monochromator was used.

The measurement by IR spectrometry (infrared spectrometry) was also made using FT/IR-420, manufactured by JASCO Corporation. The elementary analysis was made using FLASH EA1112, manufactured by ThermoQuest Corporation.

A process for producing electrophotographic photosensitive members and a method for 3,000-sheet continuous image reproduction tested when the electrophotographic photosensitive members produced are set in electrophotographic apparatus are described below. In the following, "part(s)" refers to "part(s) by weight".

Example 1

50 parts of conductive titanium oxide particles coated with tin oxide containing 10% of antimony oxide, 25 parts of phenol resin, 20 parts of methyl cellosolve, 5 parts of methanol and 0.002 part of silicone oil (polydimethylsiloxane-polyoxyalkylene copolymer; number-average molecular weight: 3,000) were subjected to dispersion for 2 hours by means of a sand mill making use of glass beads of 1 mm in diameter, to prepare a conductive layer coating dispersion.

This conductive layer coating dispersion was dip-coated on a machined aluminum cylinder (available from The Furukawa Electric Co., Ltd.; 180 mm in diameter×360 mm in length) followed by drying at 140° C. for 30 minutes to form a conductive layer with a layer thickness of 15 μm.

Next, an intermediate layer coating solution prepared by dissolving 30 parts of methoxymethylated nylon resin (number-average molecular weight: 32,000) and 10 parts of an alcohol-soluble copolymer nylon resin (number-average molecular weight: 29,000) in a mixed solvent of 260 parts of methanol and 40 parts of butanol was dip-coated on the conductive layer, followed by drying to form an intermediate layer with a layer thickness of 0.6 μm.

Next, 10 parts of the azo compound (Exemplary Compound 1-10) obtained in Synthesis Example 1 was added to 215 parts of cyclohexanone, and then pre-dispersed for 20 hours by means of a sand mill making use of glass beads of 1 mm in diameter. Further, a solution prepared by dissolving 5 parts of poly(vinyl acetate-co-vinyl alcohol-co-vinylbenzal) (degree of benzalation: 80 mol %; weight-average molecular weight: 83,000) in 45 parts of cyclohexanone was added, and these were dispersed for 2 hours by means of the sand mill, followed by addition of 375 parts of methyl ethyl ketone to effect dilution to prepare a charge generation layer coating dispersion. This coating dispersion was dip-coated on the intermediate layer, followed by drying at 80° C. for 10 minutes to form a charge generation layer with a layer thickness of 0.25 μm.

Next, 7 parts of a charge-transporting material (A) having structure represented by the following formula:

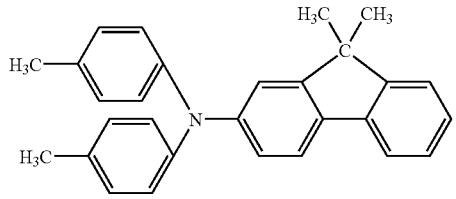

and 10 parts of polycarbonate resin (trade name: IUPILON Z-200; available from Mitsubishi Gas Chemical Company, Inc.) were dissolved in a mixed solvent of 70 parts of monochlorobenzene and 5 parts of methylal to prepare a charge transport layer coating solution, which was then dip-coated on the charge generation layer, followed by drying at 120° C. for 1 hour to form a charge transport layer with a layer thickness of 12 μm. Thus, an organic photosensitive member was obtained.

Figure 6:
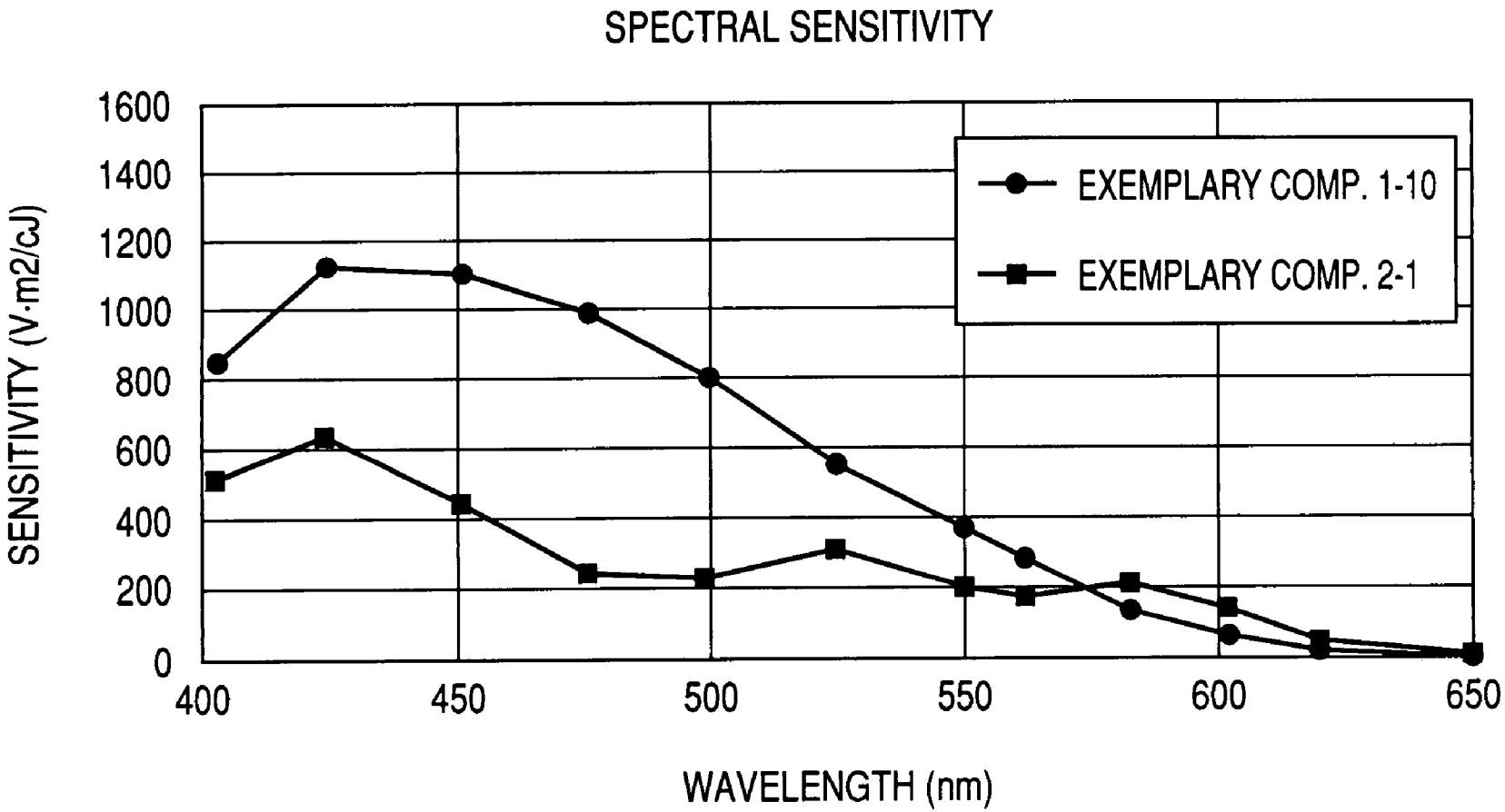
FIG. 6 shows examples of spectral sensitivity of organic photosensitive members used in Examples 1 and 8.

The spectral sensitivity ($V \cdot m^2/cJ$) of this organic photosensitive member at Δ500 (−700 V→−200V) is shown in FIG. 6. As shown in FIG. 6, the wavelength at which this organic photosensitive member showed a maximum spectral sensitivity was 424 nm. Incidentally, the wavelength at which it showed the maximum spectral sensitivity was determined by measuring photodischarge characteristics with use of a conductive glass of 10 $cm^2$ in size where a halogen lamp as a light source was set monochromatic by the use of interference filters corresponding to respective wavelengths.

Next, to the organic photosensitive member produced, flanges were fitted for rotational drive, and this photosensitive member with flanges was set in the electrophotographic apparatus constructed shown in FIG. 4 (CLC1150, manufactured by CANON INC.). To a laser exposure optical system of its exposure means, a GaN chip (manufactured by Nichia Kagaku Kogyo K.K.) was mounted, having a lasing wavelength of 405 nm and an output of 5 mW. To the destaticizer, a blue LED of 470 nm in oscillation wavelength (manufactured by Nichia Kagaku Kogyo K.K.) was mounted, and its amount of light was set three times the amount of image exposure. Also, charge potential (Vd) was so set as to be −700 V, light-area potential (Vl) −200 V, development bias −550 V, writing pitch 600 dpi, and beam spot diameter 32 μm. Using a two-component negative-toner developer for each color, full-color 3,000-sheet continuous image reproduction was carried out in an environment of 23° C. and 55% RH.

The level of variations of Vd and Vl (ΔVd, ΔVl) was measured from the initial stage until the 3,000-sheet running was finished. As the result, the potential variations before and after the running were as very small as ΔVd=−5 V (−700 V→695 V) and ΔVl =−10 V (−200 V→190 V), showing good results. Also, in image visual evaluation, full-color images with ultrahigh image quality which were free of any coarseness (non-uniformity) of halftone images and any fog at the background area and maintained a proper density were obtained from the initial stage up to 3,000 sheets.

Example 2

The 3,000-sheet continuous image reproduction was carried out in the same manner as in Example 1 except that, in the electrophotographic apparatus used in Example 1, the destaticizer blue LED of 470 nm in oscillation wavelength (manufactured by Nichia Kagaku Kogyo K.K.) was changed for a bluish green LED of 503 nm in oscillation wavelength (manufactured by Nichia Kagaku Kogyo K.K.) and its amount of light was so changed as to be set five times the amount of image exposure. As the result, the potential variations before and after the running were as small as ΔVd=−10 V and ΔVl=+35 V. Also, in image visual evaluation, full-color images with ultrahigh image quality which were free of any coarseness (non-uniformity) of halftone images and any fog at the background area and maintained a proper density were obtained from the initial stage up to 3,000 sheets.

Examples 3 to 6

The 3,000-sheet continuous image reproduction was carried out in the same manner as in Example 1 except that the azo compound Exemplary Compound 1-10 in the organic photosensitive member used in Example 1 was changed for Exemplary Compounds shown respectively in Table 9. As the result, as shown in Table 9, the potential variations were very small and images with ultrahigh image quality were obtained.

Comparative Examples 1 to 3

The 3,000-sheet continuous image reproduction was carried out in the same manner as in Example 1 except that, in the electrophotographic apparatus used in Example 1, the destaticizer blue LED of 470 nm in oscillation wavelength (manufactured by Nichia Kagaku Kogyo K.K.) was changed for a white LED of 380 nm in oscillation wavelength, a green LED of 530 nm in oscillation wavelength and a red LED of 620 nm in oscillation wavelength (all manufactured by Nichia Kagaku Kogyo K.K.), respectively, and their amounts of light were so changed as to be set five times the amount of image exposure. The results are shown in Table 9. In Comparative Example 1, the Vd came down greatly and in Comparative Examples 2 and 3 the Vl came up greatly, and hence the running potentials varied greatly to cause image difficulties such as fogging and image density decrease in each Comparative Example.

Comparative Example 4

The 3,000-sheet continuous image reproduction was carried out in the same manner as in Comparative Example 3 except that the amount of light of the red LED of 620 nm in oscillation wavelength which was the destaticizer used in Comparative Example 3 was so changed as to be set ten times the amount of image exposure instead of five times the same. The results are shown in Table 9. Although the results were a little better than those in Comparative Example 3, the running potentials still varied so greatly (the Vl came up) as to cause a decrease in image density.

Comparative Example 5

The 3,000-sheet continuous image reproduction was carried out in the same manner as in Example 1 except that, in the electrophotographic apparatus used in Example 1, the destaticizer blue LED of 470 nm in oscillation wavelength (manufactured by Nichia Kagaku Kogyo K.K.) was changed for a halogen lamp and its amount of light was so changed as to be set five times the amount of image exposure. As the result, as shown in Table 9, the Vd came down and the Vl came down, both a little greatly, and hence fog somewhat occurred and also images with a little low resolution were obtained.

Example 7

The procedure of Example 1 was repeated until the conductive layer was formed. Next, a solution prepared by dissolving 5 parts of 6-66-610-12 polyamide quadripolymer resin in a mixed solvent of 70 parts of methanol and 25 parts of butanol was dip-coated thereon, followed by drying at 100° C. for 10 minutes to form an intermediate layer with a layer thickness of 1.0 μm.

Next, 10 parts of an azo compound (Exemplary Compound 1-8) was added to 215 parts of tetrahydrofuran, and then pre-dispersed for 50 hours by means of a sand mill making use of glass beads of 0.8 mm in diameter. Further, a solution prepared by dissolving 5 parts of poly(vinyl acetate-co-vinyl alcohol-co-vinylbenzal) (degree of benzalation: 80 mol %; weight-average molecular weight: 83,000) in 45 parts of tetrahydrofuran was added, and these were dispersed for 5 hours by means of the sand mill, followed by addition of 150 parts of tetrahydrofuran and 225 parts of cyclohexanone to effect dilution to prepare a charge generation layer coating dispersion. This coating dispersion was dip-coated on the intermediate layer, followed by drying at 90° C. for 10 minutes to form a charge generation layer with a layer thickness of 0.35 μm.

Next, 6 parts of a charge-transporting material (A) having structure represented by the following formula:

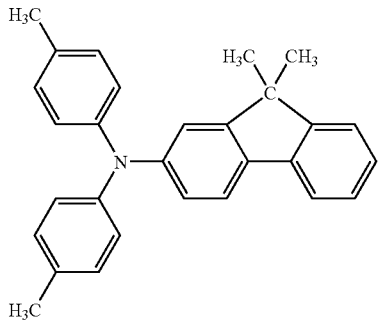

1 part of a charge-transporting material (B) having structure represented by the following formula:

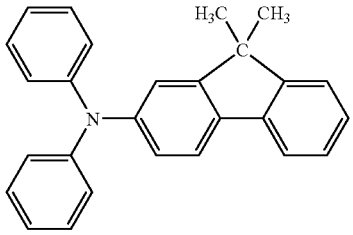

and 10 parts of polycarbonate resin (trade name: IUPILON Z-800; available from Mitsubishi Gas Chemical Company, Inc.) were dissolved in 70 parts of monochlorobenzene to prepare a charge transport layer coating solution, which was then dip-coated on the charge generation layer, followed by drying at 110° C. for 1 hour to form a charge transport layer with a layer thickness of 10 μm. Thus, an organic photosensitive member was obtained. The wavelength at which this organic photosensitive member showed a maximum spectral sensitivity was 465 nm.

Using this organic photosensitive member, the 3,000-sheet continuous image reproduction was carried out in the same manner as in Example 1. As the result, as shown in Table 9, the potential variations were very small, and good images with ultrahigh image quality were obtained.

Comparative Example 6

The image reproduction was attempted in the same manner as in Example 1 except that the azo compound Exemplary Compound 1-10 in the organic photosensitive member used in Example 1 was changed for a comparative compound (A) represented by the following formula:

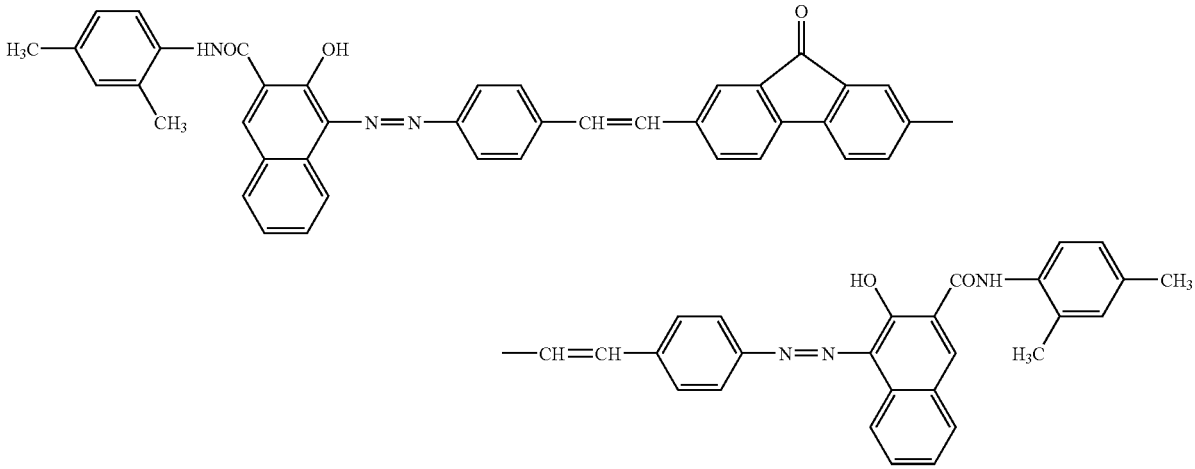

However, the wavelength at which this organic photosensitive member showed a maximum spectral sensitivity was 600 nm or more, and the sensitivity in the image exposure wavelength region was too low to set any proper Vl.

Example 8

The procedure of Example 7 was repeated until the intermediate layer was formed. Next, 4 parts of 5,10,15,20-tetra(4-pyridyl)-21H,23H-porphyrin crystals were added to a solution prepared by dissolving 2 parts of polyvinyl butyral resin (trade name: S-LEC BX-1; available from Sekisui Chemical Co., Ltd.) in 100 parts of cyclohexanone, and these were dispersed for 3 hours by means of a paint shaker, followed by addition of 150 parts of ethyl acetate to effect dilution. The dispersion thus obtained was dip-coated on the intermediate layer so as to be in a layer thickness of 0.3 μm after drying, followed by drying at 100° C. for 10 minutes to form a charge generation layer.

Next, 6 parts of a charge-transporting material (A) having structure represented by the following formula:

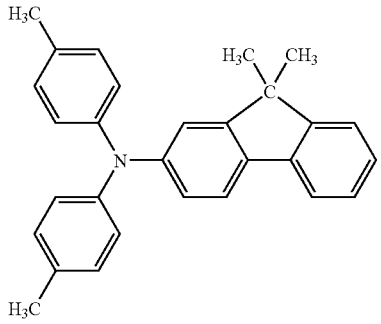

1 part of a charge-transporting material (C) having structure represented by the following formula:

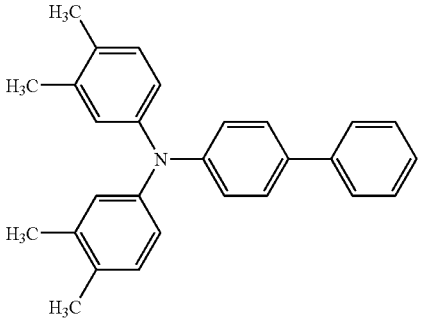

and 10 parts of polycarbonate resin (trade name: IUPILON Z-400; available from Mitsubishi Gas Chemical Company, Inc.) were dissolved in a mixed solvent of 70 parts of monochlorobenzene and 5 parts of methylal to prepare a charge transport layer coating solution, which was then dip-coated on the charge generation layer, followed by drying at 120° C. for 1 hour to form a charge transport layer with a layer thickness of 15 μm. Thus, an organic photosensitive member was obtained. The spectral sensitivity ($V \cdot m^2/cJ$) of this organic photosensitive member at Δ500 (−700 V→−200V) is shown in FIG. 6. As shown in FIG. 6, the wavelength at which this organic photosensitive member showed a maximum spectral sensitivity was 424 nm.

Using this organic photosensitive member, the 3,000-sheet continuous image reproduction was carried out in the same manner as in Example 1. As the result, as shown in Table 9, the potential variations were small, and good images with ultrahigh image quality were obtained.

Example 9

The 3,000-sheet continuous image reproduction was carried out in the same manner as in Example 1 except that, in the electrophotographic apparatus used in Example 1, the position of the destaticizer, which was pre-charging exposure, was changed to pre-cleaning exposure. As the result, as shown in Table 9, the potential variations were very small, and good images with ultrahigh image quality were obtained.

TABLE 9

| | Exemplary Comp. | λa/λc/λb (nm) | Sb/Sa | ΔVd (V) | ΔV1 (V) | Image visual evaluation |
|---|---|---|---|---|---|---|
| | | | Example: | | | |
| 1 | 1–10 | 405/424/470 | 1.17 | +5 | +5 | Ultrahigh. |
| 2 | 1–10 | 405/424/503 | 0.95 | −10 | +35 | Ultrahigh. |
| 3 | 1–7 | 405/451/470 | 1.24 | −5 | +10 | Ultrahigh. |
| 4 | 1–27 | 405/440/470 | 1.05 | 0 | +20 | Ultrahigh. |
| 5 | 1–66 | 405/451/470 | 1.14 | +10 | +15 | Ultrahigh. |
| 6 | 1–57 | 405/465/470 | 0.80 | +15 | +45 | Ultrahigh. |
| 7 | 1–16 | 405/450/470 | 1.50 | +5 | +10 | Ultrahigh. |
| 8 | 2–1 | 405/424/470 | 0.48 | +20 | +40 | Ultrahigh. |
| 9 | 1–10 | 405/424/470 | 1.17 | +5 | +10 | Ultrahigh. |
| | | | Comparative Example: | | | |
| 1 | 1–10 | 405/424/380 | 0.71 | −120 | +50 | Fogged greatly. |
| 2 | 1–10 | 405/424/530 | 0.65 | −20 | +120 | A little low density. |
| 3 | 1–10 | 405/424/620 | 0.05 | −30 | +250 | Low density. |
| 4 | 1–10 | 405/424/620 | 0.05 | −25 | +190 | Low density. |
| 5 | 1–10 | 405/424/— | — | −60 | +60 | Fogged a little, somewhat low density. |
| 6 | CC A | 405/>650/470 | >2.0 | | | Sensitivity is too low to set Vl. |

CC: Comparative Compound

POSSIBILITY OF INDUSTRIAL APPLICATION

The electrophotographic apparatus having the blue (purple) semiconductor laser as a light source can be provided, which may cause less running potential variations and enables reproduction of stable images with ultrahigh image quality throughout its running. It is applicable to image forming apparatus such as copying machines, printers, facsimile machines and platemaking systems, which employ electrophotographic processes.

This application claims priority from Japanese Patent Application No. 2003-395871 filed Nov. 26, 2003, which is hereby incorporated by reference herein.

What is claimed is:

1. An electrophotographic apparatus comprising an electrophotographic photosensitive member, a charging means, a semiconductor laser as an exposure means, a developing means, a transfer means and a light-emitting diode as a destaticizing means for the electrophotographic photosensitive member, wherein;

wavelength λa (nm) of said semiconductor laser, wavelength λb (nm) of said light-emitting diode and wavelength λc (nm) at which said electrophotographic photosensitive member has a maximum spectral sensitivity satisfy the following relationship (1):

$$\lambda a<\lambda c<\lambda b \quad (1)$$

and any of the λa, the λb and the λc is within the range of from 380 nm to 520 nm.

2. The electrophotographic apparatus according to claim 1, wherein photosensitive-member sensitivity Sa ($V\cdot m^2/cJ$) at said λa (nm) and photosensitive-member sensitivity Sb ($V\cdot m^2/cJ$) at said λb (nm) satisfy the following relationship (2):

$$Sb/Sa \geqq 0.8 \quad (2).$$

3. The electrophotographic apparatus according to claim 2, wherein the photosensitive-member sensitivity Sa ($V\cdot m^2/cJ$) at the λa (nm) and the photosensitive-member sensitivity Sb ($V\cdot m^2/cJ$) at the λb (nm) satisfy the following relationship (3):

$$Sb/Sa \geqq 1.0 \quad (3).$$

4. The electrophotographic apparatus according to any one of claims 1 to 3, wherein said electrophotographic photosensitive member is an organic photosensitive member.

5. The electrophotographic apparatus according to claim 4, wherein said organic photosensitive member has a photosensitive layer containing as a charge-generating material an azo compound having the following structural formula (4):

$$Cp1—N=N—Ar—N=N—Cp2 \quad (4)$$

wherein Ar represents a substituted or unsubstituted aromatic hydrocarbon ring, a substituted or unsubstituted heterocyclic ring or a ring formed by combination of these directly or via a linking group, and Cp1 and Cp2 independently represent coupler residual groups having phenolic hydroxyl groups of the same type or different types; except, however, that the —N=N—Cp1 and —N=N—Cp2 moieties are bonded to the same benzene ring.

6. The electrophotographic apparatus according to claim 4, wherein said organic photosensitive member has a photosensitive layer containing as a charge-generating material a porphyrin compound having the following structural formula (5):

(5)

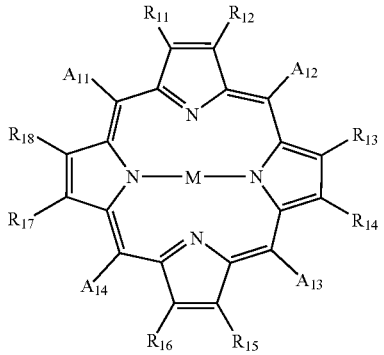

wherein M represents a hydrogen atom or a metal which may have an axial ligand; $R_{11}$ to $R_{18}$ each independently represent a hydrogen atom, an alkyl group which may have a substituent, an aromatic ring which may have a substituent, an amino group which may have a substituent, a sulfur atom which may have a substituent, an alkoxyl group, a halogen atom, a nitro group or a cyano group; $A_{11}$ to $A_{14}$ each independently represent a hydrogen atom, an alkyl group which may have a substituent, an aromatic ring which may have a substituent, or a heterocyclic ring which may have a substituent, provided that at least one of them represents a heterocyclic ring which may have a substituent.

7. The electrophotographic apparatus according to claim 5, wherein said azo compound of the structural formula (4) is represented by the following structural formula (6):

(6)

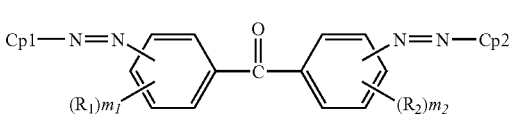

wherein $R_1$ and $R_2$ may be the same or different and each independently represent an alkyl group which may have a substituent, an aryl group which may have a substituent, or a halogen atom; $m_1$ and $m_2$ each represent an integer of 0 to 4; and Cp1 and Cp2 independently represent coupler residual groups having phenolic hydroxyl groups of the same type or different types.

8. The electrophotographic apparatus according to claim 5, wherein at least one of the Cp1 and Cp2 in said structural formula (4) is represented by the following structural formula (7) or (8):

(7)

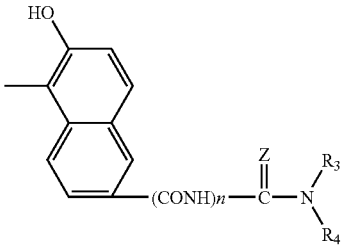

(8)

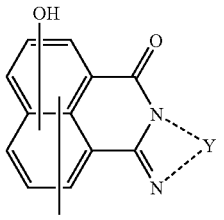

wherein $R_3$ and $R_4$ each represent a hydrogen atom, an alkyl group which may have a substituent, an aryl group which may have a substituent, or a heterocyclic ring group which may have a substituent, and $R_3$ and $R_4$ may form a cyclic amino group via the nitrogen atom in the formula; Z represents an oxygen atom or a sulfur atom; n represents an integer of 0 or 1; and Y represents a divalent aromatic hydrocarbon ring group which may have a substituent, or a divalent nitrogen-containing heterocyclic ring group which may have a substituent.

9. The electrophotographic apparatus according to claim 5, wherein said structural formula (4) is the following structural formula (6), and at least one of the Cp1 and Cp2 is represented by the following structural formula (7) or (8):

(6)

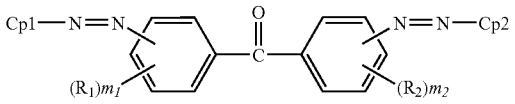

wherein $R_1$ and $R_2$ may be the same or different and each independently represent an alkyl group which may have a substituent, an aryl group which may have a substituent, or a halogen atom; and $m_1$ and $m_2$ each represent an integer of 0 to 4;

(7)

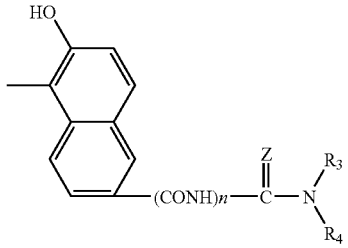

(8)

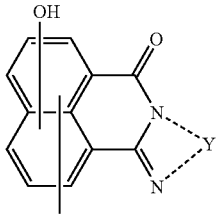

wherein $R_3$ and $R_4$ each represent a hydrogen atom, an alkyl group which may have a substituent, an aryl group which may have a substituent, or a heterocyclic ring group which may have a substituent, and $R_3$ and $R_4$ may form a cyclic amino group via the nitrogen atom in the formula; Z represents an oxygen atom or a sulfur atom; n represents an integer of 0 or 1; and Y represents a divalent aromatic hydrocarbon ring group which may have a substituent, or a divalent nitrogen-containing heterocyclic ring group which may have a substituent.

10. The electrophotographic apparatus according to claim 6, wherein said compound represented by the structural formula (5) is a 5,10,15,20-tetrapyridyl-21H,23H-porphyrin compound, in which $R_{11}$ to $R_{18}$ are all hydrogen atoms and $A_{11}$ to $A_{14}$ are all pyridyl groups.

11. The electrophotographic apparatus according to claim 10, wherein said 5,10,15,20-tetrapyridyl-21H,23H-porphyrin compound is a 5,10,15,20-tetra(4-pyridyl)-21H,23H-porphyrin crystal of a crystal form having peaks at 8.2°, 19.7°, 20.8° and 25.9° of Bragg's angle (2θ±0.2°) in the CuKα characteristic X-ray diffraction.

12. The electrophotographic apparatus according to any one of claims 1 to 3, wherein said destaticizing means is provided in such a way that it performs any one, or two or more, of charging pre-exposure, transfer pre-exposure, transfer simultaneous exposure and cleaning pre-exposure.

* * * * *